US010314358B1

(12) United States Patent
Mao

(10) Patent No.: US 10,314,358 B1
(45) Date of Patent: Jun. 11, 2019

(54) CAP AND METHOD OF MANUFACTURING A CAP

(71) Applicant: Shanghai Pacific Hat Manufacturing Company, LTD, Shanghai (CN)

(72) Inventor: Zhen Mao, Shanghai (CN)

(73) Assignee: Shanghai Pacific Hat Manufacturing Co., LTD, Shanghai (CN)

( * ) Notice: Subject to any disclaimer, the term of this patent is extended or adjusted under 35 U.S.C. 154(b) by 0 days.

(21) Appl. No.: 16/270,939

(22) Filed: Feb. 8, 2019

Related U.S. Application Data

(63) Continuation of application No. 16/316,380, filed as application No. PCT/CN2017/092671 on Jul. 12, 2017, which is a continuation-in-part of application No. PCT/CN2016/089914, filed on Jul. 13, 2016.

(51) Int. Cl.

| | |
|---|---|
| ***A41B 1/20*** | (2006.01) |
| ***A42B 1/22*** | (2006.01) |
| ***A42B 1/02*** | (2006.01) |
| ***A42B 1/20*** | (2006.01) |

(52) U.S. Cl.
CPC ..... *A42B 1/22* (2013.01); *A42B 1/02* (2013.01); *A42B 1/208* (2013.01)

(58) Field of Classification Search
CPC ..... A42B 1/205; A42B 1/208
USPC ..... 2/195.4
See application file for complete search history.

(56) References Cited

U.S. PATENT DOCUMENTS 1,614,231 A * 1/1927 Cosgrove ..... A42B 1/208 132/274
1,808,681 A * 6/1931 Rayburn ..... A42B 1/208 132/274
2,343,155 A * 2/1944 Morris ..... A42B 1/061 2/195.3
3,041,628 A * 7/1962 Fish ..... A42B 1/208 2/195.2
4,790,034 A 12/1988 Pass
(Continued)

FOREIGN PATENT DOCUMENTS

CN 1526336 A 9/2004
CN 201612191 U 10/2010
(Continued)

OTHER PUBLICATIONS

Canadian Office Action for Canadian Patent Application No. 3,030,433 dated Mar. 1, 2019.
(Continued)

*Primary Examiner* — Tajash D Patel
(74) *Attorney, Agent, or Firm* — Locke Lord LLP

(57) ABSTRACT

A baseball cap and method of assembling thereof is provided. The cap includes a crown that is formed from a single sheet or single piece of stretchable fabric, such as using heat pressing techniques. The cap further includes a support layer, such as made from buckram, which is attached to an interior, front portion of the crown, and a visor and a band which are attached to the crown. The crown has a hemispherical shape. In one example, the crown can include a back portion thereof which has been removed to form an open area across which an adjuster is attached. In another example, a front portion of the single-panel crown can be removed and replaced with a front panel made of a different material to form a modified crown.

30 Claims, 18 Drawing Sheets

(56) References Cited

U.S. PATENT DOCUMENTS

| | | | | |
|---|---|---|---|---|
| 5,099,524 | A * | 3/1992 | Linday | A41D 20/00 2/10 |
| 5,247,709 | A * | 9/1993 | Epply | A42B 1/208 2/175.1 |
| 5,724,675 | A | 3/1998 | Lipkin et al. | |
| 6,363,537 | B1 | 4/2002 | Park | |
| 6,446,266 | B1 | 9/2002 | Park | |
| 6,484,323 | B1 * | 11/2002 | Pu | A42B 1/201 2/10 |
| 7,036,156 | B2 | 5/2006 | Lahman et al. | |
| 2007/0056078 | A1 | 3/2007 | Tseng | |
| 2007/0130669 | A1 * | 6/2007 | Rogers | A42B 1/062 2/195.1 |
| 2010/0205715 | A1 | 8/2010 | Dillavou | |
| 2016/0021961 | A1 * | 1/2016 | Lacy | A42B 1/22 2/195.4 |
| 2018/0116325 | A1 * | 5/2018 | Woods | A42B 1/18 |

FOREIGN PATENT DOCUMENTS

| | | | |
|---|---|---|---|
| CN | 102742957 | A | 10/2012 |
| DE | 102014100220 | A1 | 6/2015 |
| KR | 20150004276 | U | 11/2015 |
| WO | WO 0036941 | A1 | 6/2000 |
| WO | WO 2004054397 | A1 | 7/2004 |

OTHER PUBLICATIONS

International Search Report and Written Opinion for International Application No. PCT/CN2017/092671 dated Sep. 27, 2017.

International Search Report and Written Opinion for International Application No. PCT/CN2016/089914 dated Apr. 19, 2017.

* cited by examiner

CAP AND METHOD OF MANUFACTURING A CAP

RELATED CASES

The present application claims priority to U.S. Ser. No. 16/316,380, filed Jan. 9, 2019, as a 371 of the Continuation-In-Part International Application No. PCT/2017/092671, filed Jul. 12, 2017, which claims priority to PCT/CN2016/089914 filed on Jul. 13, 2016, of which all of the applications are incorporated by reference herein in their entirety.

FIELD

The present disclosure is related to a method of assembling or manufacturing headwear such as a cap, and more particularly, to a cap assembly that incorporates a single-panel crown formed of stretchable fabric.

BACKGROUND

Headwear can include various components, such as a crown and a visor (e.g., bill). One type of headwear is a hat, such as a cap or a baseball cap, in which the crown is traditionally formed of six (6) crown panels or 5/4/3/2 crown panels because the fabric is flat, unless the crown is specially hand-crocheted with yarn. However, the multiple crown panels are connected together using conventional attachment techniques, such as stitching or sewing. Such conventional manufacturing techniques increase the time, complexity and cost of assembling or manufacturing components of a cap together. These types of conventional caps also are restrictive in terms of head size ranges, and thus, must be made in many different sizes to accommodate different wearers. Furthermore, the materials used for the flat crown panels in these caps are susceptible to wrinkling, particularly those which use heavier fabrics.

SUMMARY

In accordance with example embodiments, a cap and method of assembling thereof is provided, which employ a single-panel crown formed of a stretchable fabric. The method of assembling a cap, such as for example a baseball cap, involves forming a single-panel crown for a cap from a single sheet or single piece of stretchable fabric, removing a back portion of the crown to form an open area, attaching a support layer to an interior, front portion of the single-panel crown with an adhesive, and attaching a visor and a band (such as an elastic (or stretchable) band, inelastic band or a sweatband) to the crown with the attached support layer. The single-panel crown can be formed by heating and stretching the single sheet or single piece of stretchable fabric to form a hemispherical shape on a portion of the stretchable fabric, and cutting any extra edge portion or portions of the stretchable fabric that extend from or beyond the hemispherical shaped portion in order to form the single-panel crown for the cap. Heat can be applied to one or both sides of the stretchable fabric, and as heat is applied, a pressing force can be applied to the stretchable fabric using a hemispherical shaped fabric mold to stretch the portion of the stretchable fabric into the hemispherical shape. In one example, only a male mold part is utilized to apply the press force to press and stretch the fabric. The stretchable fabric can be made of a woven or non-woven material, and can be an elastic fabric (or fabric with elastic properties) that includes 2% to 5% spandex, preferably around 3%. of spandex.

The back portion, which is removed, can have an arcuate shape or a triangular shape. A layer of material can be attached along an edge of a back of the crown which is formed by the removal of the back portion. This layer of material can be formed of a material which is different than, e.g., more rigid than, the material of the crown, and can reinforce the edge of the crown around the open area. Furthermore, the removing operation can involve attaching a layer of material to a back of the crown where the layer of material has a predefined shape corresponding to a desired shape of the open area; and removing a portion of the layer of material along with the crown to form the open area with the desired shape so that a strip of the layer of material runs along an edge of a back of the crown around the open area.

The support layer can be made of buckram. To attach the support layer to the single-panel crown, a coat of an adhesive can be applied to a surface of the buckram or an interior, front portion of the single-panel crown. The buckram can then be pressed (e.g., heat pressed) against the interior, front portion of the single-panel crown so that the adhesive bonds the buckram to the interior, front portion of the single-panel crown. Furthermore, bonding tape can be applied over one or more seams that are formed between an edge of the buckram and an interior surface of the single-panel crown. Each of the one or more seams extends radially from an interior, central portion to a bottom edge of the single-panel crown, and the bonding tape covers the one or more seams and further connects the buckram to the single-panel crown.

The cap can also include an adjuster which is attached to a bottom of the crown across the open area at a back of the crown, or utilize a band such as an elastic band which extends across the open area.

In accordance with a further example embodiment, a cap and method of assembling thereof is provided, which modifies a single-panel crown formed of a stretchable fabric by incorporating a different front panel to form a modified crown. In this example, the method of assembling a cap, such as for example a baseball cap, involves forming an initial single-panel crown from a single sheet or single piece of stretchable fabric, removing a front portion of the initial single-panel crown, attaching a front panel to the crown to replace the removed front portion and to form a modified crown for a cap, and attaching a visor and a band to the modified crown. The front panel can be smaller than the initial single-panel crown with the removed front portion, can be formed of a different material than the initial crown, and can have a support layer attached on an interior side thereof. The support layer can be attached to the front panel prior to attaching the front panel to the initial single-panel crown with the removed front portion. The stretchable fabric can be made of a woven or non-woven material, or include 2% to 5% spandex. An edge of the initial single-panel crown with the removed front portion can be attached over an edge of the front panel (or vice-a-versa).

The various example caps with a single-panel crown or a modified crown using an initial single-panel crown are designed to provide numerous benefits over conventional caps. For example, the single-panel crown can be formed from a stretchable fabric in a manner that requires substantially less labor in comparison to conventional crowns such as those formed by connecting multiple flat crown panels or by hand crocheting yarn. Thus, with a single-panel crown design as described herein, it is possible to assemble or manufacture a cap (e.g., a baseball cap) in a more efficient, faster and less costly manner in comparison to conventional caps. Furthermore, a cap with such a single-panel crown is able to cover a larger range of head sizes, has increased or improved tear strength by eliminating the need for stitching ordinarily employed to connect multiple flat crown panels together in conventional caps, and is less susceptible to wrinkling particularly when employing light or lighter stretchable fabric for the crown.

BRIEF DESCRIPTION OF THE DRAWINGS

The description of the various exemplary embodiments is explained in conjunction with the appended drawings, in which.

DETAILED DESCRIPTION OF THE EXAMPLE EMBODIMENTS

Figure 1:
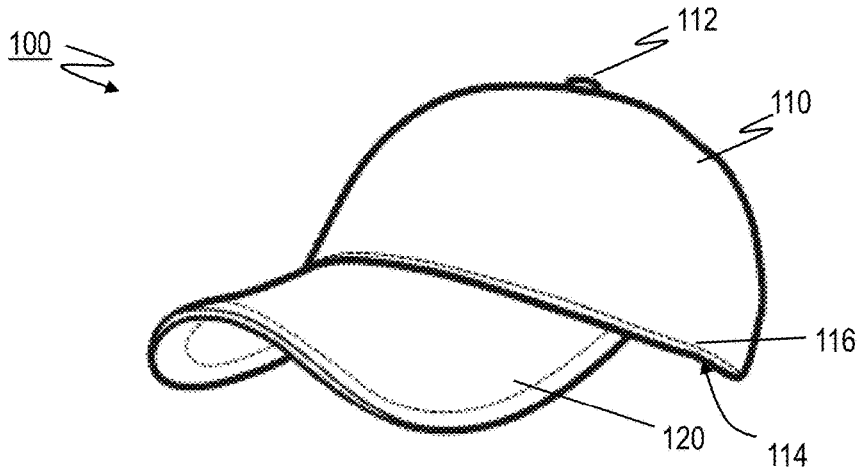
FIG. 1 is a perspective view of an example headwear, such as an example cap that incorporates a single-panel crown formed from a single sheet or single piece of stretchable fabric, in accordance with an exemplary embodiment of the present disclosure.
Figure 2:
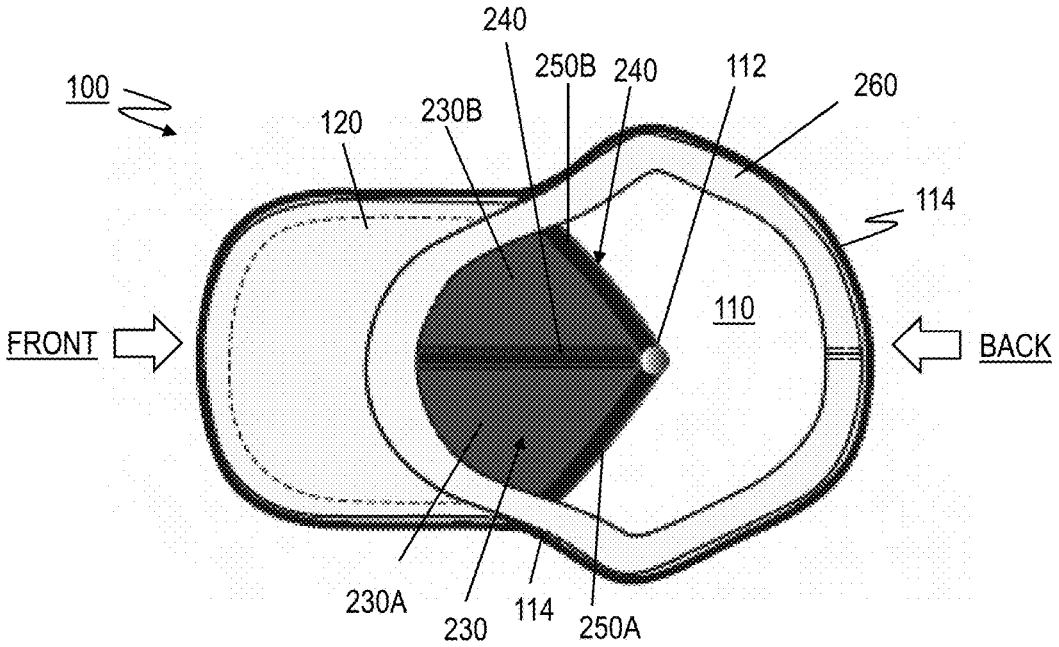
FIG. 2 is a bottom view showing an interior or inside of the single-panel crown of the cap in FIG. 1.

FIGS. 1 and 2 illustrate a headwear, such as a cap 100. As shown in FIG. 1, the cap 100 includes a single-panel crown 110. A top button 112 and a visor 120 are attached (or connected) to the crown 110. The single-panel crown 110 has a hemispherical shape (e.g., a dome shape) and is formed of a stretchable fabric, preferably a light or lighter stretchable fabric. The fabric can be a woven or non-woven material, and can be an elastic fabric that is formed, such as for example with spandex (e.g., between 2% and 5% spandex, preferably around 3% spandex). As will be described in greater detail below, the single-panel crown 110 can be formed by heating and stretching a single sheet or single piece of a stretchable fabric into a hemispherical shape using a heat pressing system or heat press transfer machine with a suitable fabric-shaping mold or fabric mold (e.g., a hemispherical-shaped fabric mold).

As further shown in FIG. 2, the cap 100 also includes a support layer 230, and an elastic band 260. The support layer 230 is attached to an interior or inside of the single-panel crown 110 to provide structural support for a desired portion(s) of the single-panel crown 110 of the cap 100. In this example, the support layer 230 is attached to an interior, front portion of the single-panel crown 110.

The support layer 230 can be formed as a single panel or by connecting multiple support panels. For example, as shown in FIG. 2, the support layer 230 includes two support panels 230A and 230B, which can be connected together along their seam such as, for example, by sewing or stitching, with bonding tape, with an adhesive, or a combination thereof. In this example, the two support panels 230A and 230B together with a strip 240 of bonding tape or fabric are stitched and the strip 240 covers the seam between the support panels 230A and 230B. The support layer 230 can be formed of a rigid material, such as buckram.

The support layer 230 can be attached to the interior or inside of the single-panel crown 110 through heat transfer techniques using an adhesive (e.g., a fabric adhesive), as well as using bonding tape. As shown in FIG. 2, two strips 250A and 250B of bonding tape are applied along respective seams between an outer edge or periphery of the support layer 230 and the interior of the single-panel crown 110. The strips 250A and 250B of bonding tape further attach the support layer 230 to the single-panel crown 110, and cover respective seams therebetween that extend radially from a central or center portion to a bottom edge (or rim) 114 of the single-panel crown 110. The bonding tape, as used herein, can be a single-sided or double-sided heat bonding tape or adhesive tape (e.g., a pressure sensitive adhesive tape). An adhesive, as used herein, can be a fabric adhesive that is applied with or without heat to bond two or more components together.

The elastic band 260 is attached around an interior of the bottom edge 114 of the single-panel crown 110 with the attached support layer 230. The elastic band 260 can be a sweatband. The visor 120 and the elastic band 260 can be attached to the single-panel crown 110 by sewing or stitching them to the single-panel crown 110 (see e.g., stitches or stitching 116 in FIG. 1).

Figure 3:
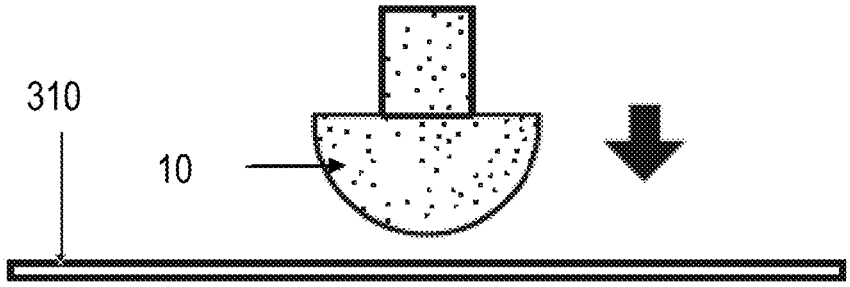
FIGS. 3 through 8 illustrate various operations involved in an exemplary process of assembling or manufacturing a cap such as in FIG. 1.
Figure 4:
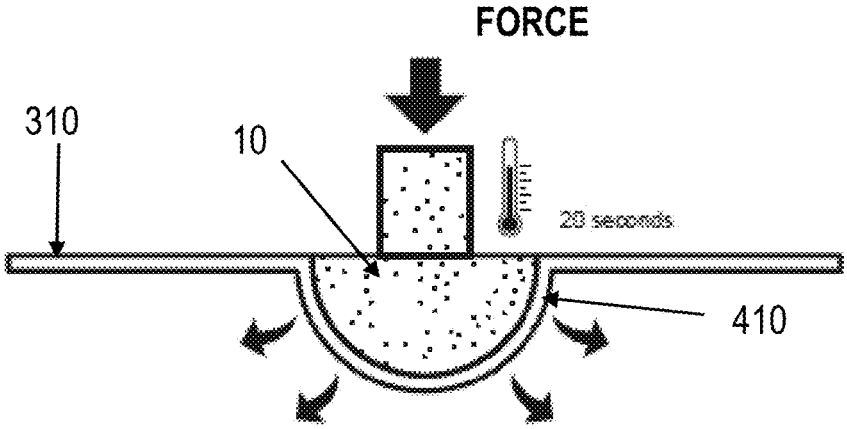

FIGS. 3 through 8 illustrate an exemplary step-by-step process of assembling or manufacturing a cap with a single-panel crown, such as shown in FIG. 1. As shown in FIGS. 3 and 4, a single sheet or single piece of stretchable fabric 310 is provided. The stretchable fabric 310 can be an elastic fabric. A portion of the stretchable fabric 310 is heated and pressed with a sufficient force by a hemispherical-shaped fabric mold 10 (of a heat press transfer machine or heat pressing system) to form a hemispherical shape on the fabric 310, i.e., a hemispherical-shaped portion 410. The amount of force, temperature and time used in the heating and stretching processes can vary according to the properties of the stretchable fabric 310 in the heating and stretching operations. The size and shape of the mold 10 can be changed, as desired, to accommodate different types of caps and head sizes or head size ranges.

Figure 5:
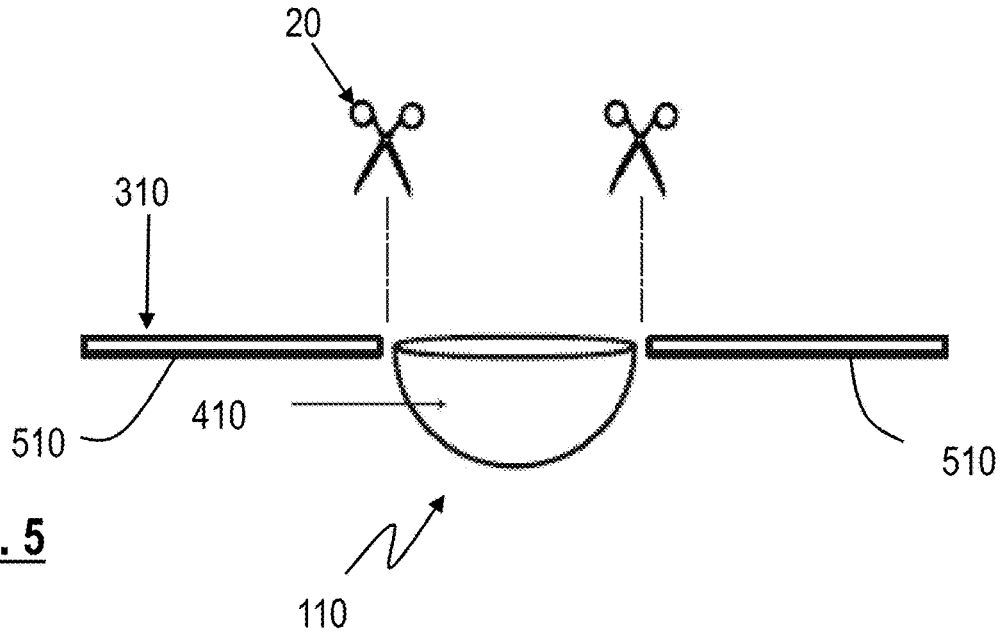

As shown in FIG. 5, the stretchable fabric 310 is subsequently cut or trimmed, if necessary, to remove any extra edge portion or portions 510 that extend beyond the hemispherical-shaped portion 410. In this way, a single-panel crown 110 is formed from the hemispherical-shaped portion 410 of the stretchable fabric 310. As an alternative, the stretchable fabric 310 can be cut beforehand or pre-cut into a fabric blank (e.g., a circular or oval blank of the stretchable fabric 310) with a suitable size and shape to avoid the necessity of performing a trimming or cutting operation after the heating and stretching processes. For example, the fabric blank can be heated and stretched, as described herein, to form the single-panel crown 110 with a hemispherical shape.

Figure 6:
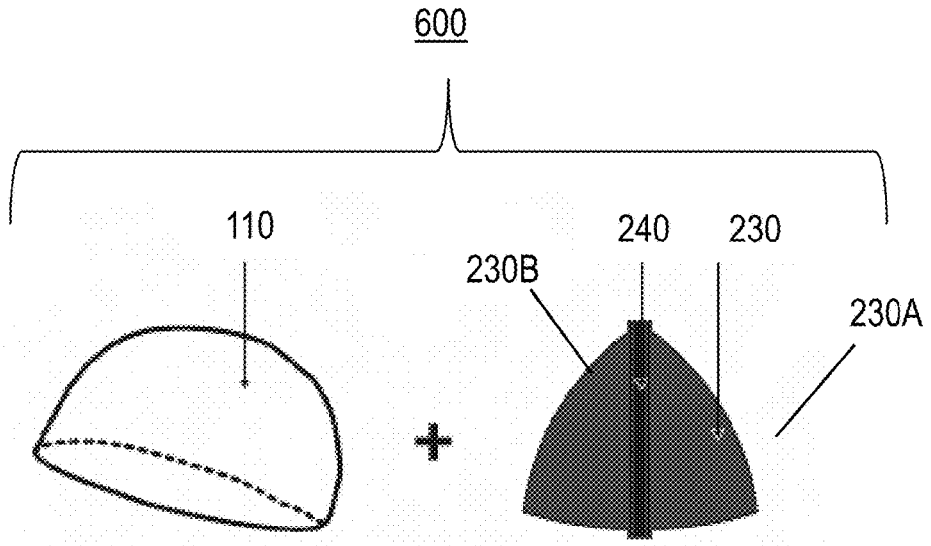

As shown in FIG. 6, a support layer 230 is to be attached to an interior or inside of the single-panel crown 110, which is noted by reference 600. In this example, the support layer 230 is formed of two support panels 230A and 230B (e.g. triangular-shaped panels), which are connected by sewing or stitching along a seam formed by adjacent outer edges of the support panels 230A and 230B. For example, a strip 240 of fabric or bonding tape, which is applied over the seam between the support panels 230A and 230B, is sewed or stitched to attach or to further attach the support panels 230A and 230B along with the strip 240 together. However, the support panels 230A and 230B can be attached in other ways, such as using adhesives (e.g. fabric adhesives), bond taping, etc.

Figure 7:
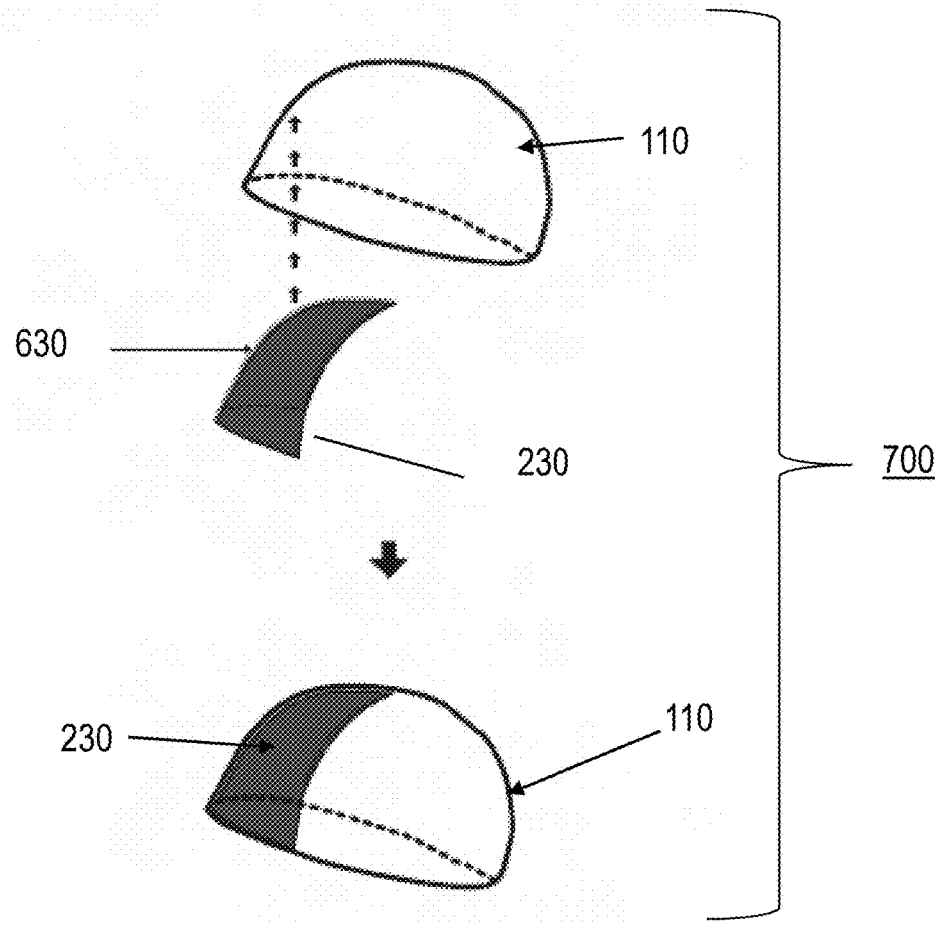
Figure 8:
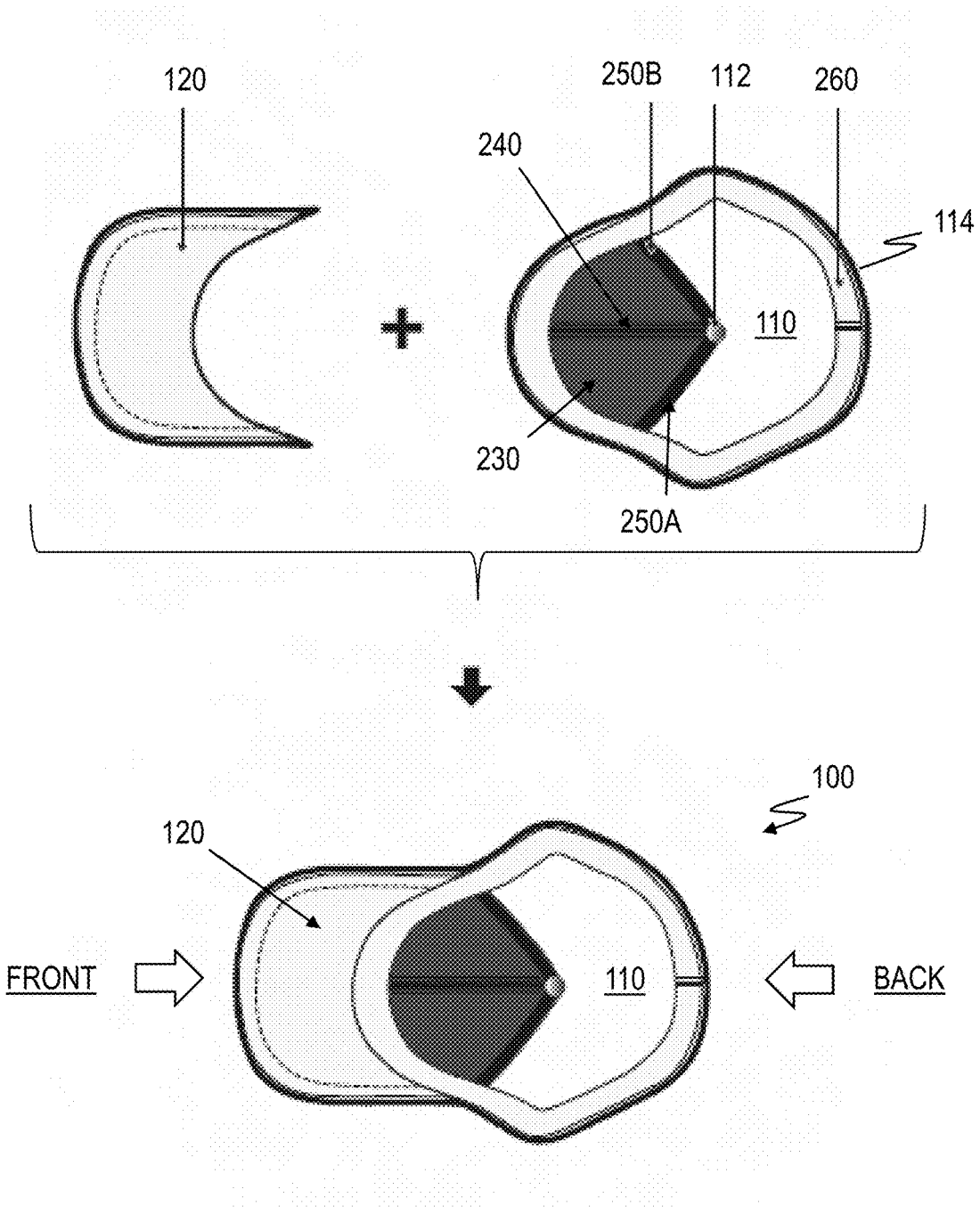

As shown by reference 700 in FIG. 7, the support layer 230 can be attached to the interior or inside of the single-panel crown 110 using an adhesive 630 (e.g., fabric adhesive). For example, a coating of the adhesive 630 is applied on one side or surface of the support layer 230. The support layer 230 is thereafter inserted into the single-panel crown 110, and then pressed against an interior, front portion of the single-panel crown 110 to attach the support layer 230 to the single-panel crown 110. As shown in FIG. 8, two strips 250A and 250B of bonding tape are applied along respective seams between an outer edge or periphery of the support layer 230 and the interior of the single-panel crown 110 (also referred to as "seamless taping"). The strips 250A and 250B of bonding tape further attach the support layer 230 to the single-panel crown 110, and cover respective seams therebetween that extend radially from a central or center portion to a bottom edge (or rim) 114 of the single-panel crown 110. The top button 112 is also attached to a central portion or center of the single-panel crown 110 with a metal snap or the like.

As further shown in FIG. 8, a visor 120, an elastic band 260 are attached to the single-panel crown 110 with the support layer 230. For example, the elastic band 260 is attached around an interior of the bottom edge 114 of the single-panel crown 110 with the attached support layer 230. The visor 120 and the elastic band 260 can be attached to the single-panel crown 110 by sewing or stitching them together to the single-panel crown 110 (see e.g., stitches or stitching 116 in FIG. 1) or separately to the single-panel crown 110.

Figure 9:
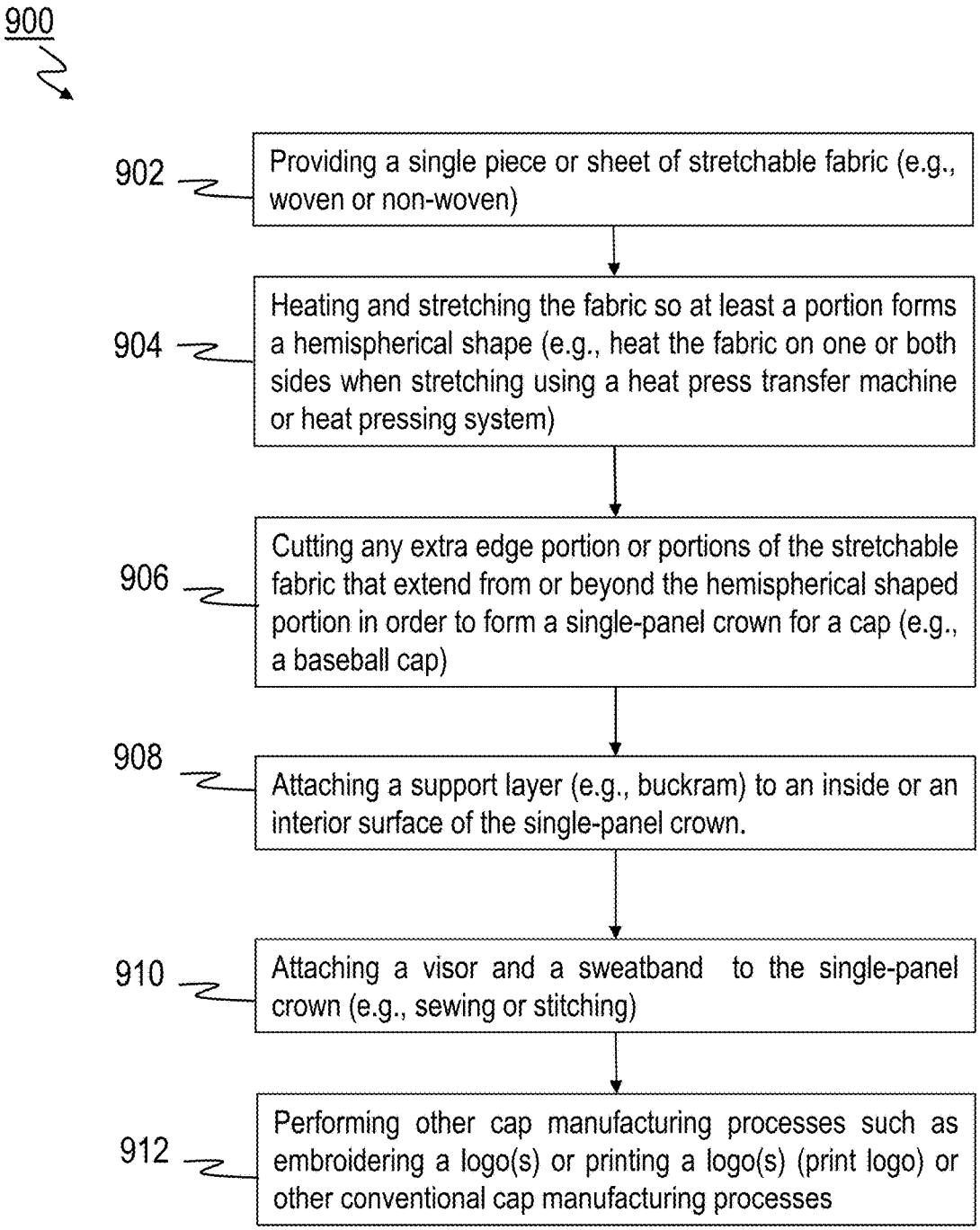
FIG. 9 is a flow diagram of an exemplary process of assembling or manufacturing headwear, such as the cap in FIG. 1.

FIG. 9 is a flow diagram of an exemplary process 900 by which a headwear, such as for example a cap as shown in FIG. 1, is assembled and manufactured with a single-panel crown. The process 900 can begin with the provision of a single sheet or single piece of stretchable fabric, at reference 902. The stretchable fabric can be made of woven or non-woven material, and can preferably be a light or lighter stretchable fabric. As previously discussed, the stretchable fabric can be an elastic fabric that incorporates spandex, such as for example between 2% to 5% of spandex or preferably around 3% of spandex.

At reference 904, the stretchable fabric is heated and stretched so at least a portion thereof forms a hemispherical shape (e.g., a dome or half-sphere shape). A hemispherical-shaped fabric mold or other suitable fabric mold of a heat press transfer machine or heat pressing system can be used to heat press, and thus, stretch the stretchable fabric into a desired shape (or dimensions). The stretchable fabric can be heated on one or both sides when stretching the fabric.

At reference 906, any extra edge portion or portions of the stretchable fabric that extend from or beyond the hemispherical-shaped portion is cut or trimmed off in order to form a single-panel crown for a cap.

At reference 908, a support layer is attached to an inside or interior surface of the single-panel crown. For baseball or similar caps, the support layer can be attached to an interior, front portion of the single-panel crown. As previously discussed, the support layer can be made of buckram, and can be formed of one or more support panels which are attached together such as by sewing or stitching, adhesive (e.g., fabric adhesive), bonding tape or a combination thereof, or by other conventional attachment techniques. For example, the support layer can initially be attached to the single-panel crown with an adhesive, and then bonding tape can be applied over the seams between outer edge or periphery of the support layer and the interior of the single-panel crown.

At reference 910, the visor and the elastic band (e.g., a sweatband) is attached to the single-panel crown, such as by sewing or stitching. The visor and the elastic band can be attached separately to the single-panel crown or attached together (e.g., at the same time or simultaneously) to the single-panel crown.

At reference 912, other cap manufacturing processes may be performed to customize the cap. For example, these and other conventional cap manufacturing processes may include embroidering a logo(s) or printing a logo(s), e.g., a print logo, on the cap.

Figure 10:
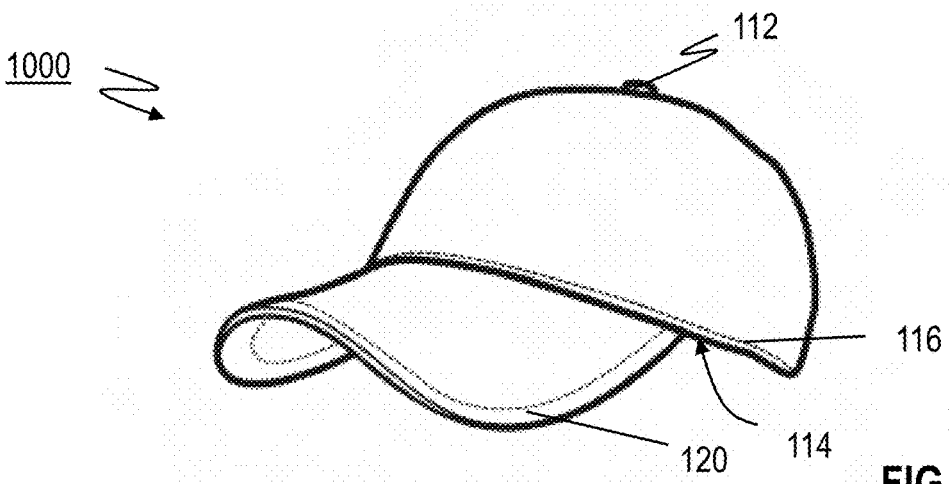
FIGS. 10, 11 and 12 are a top perspective view, a back view and a bottom view, respectively, of an example headwear such as a cap in accordance with a further embodiment of the present disclosure.
Figure 11:
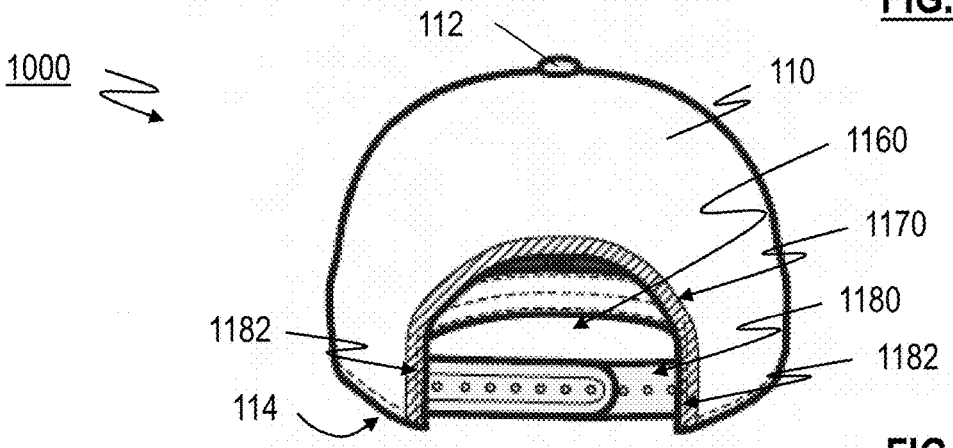
Figure 12:
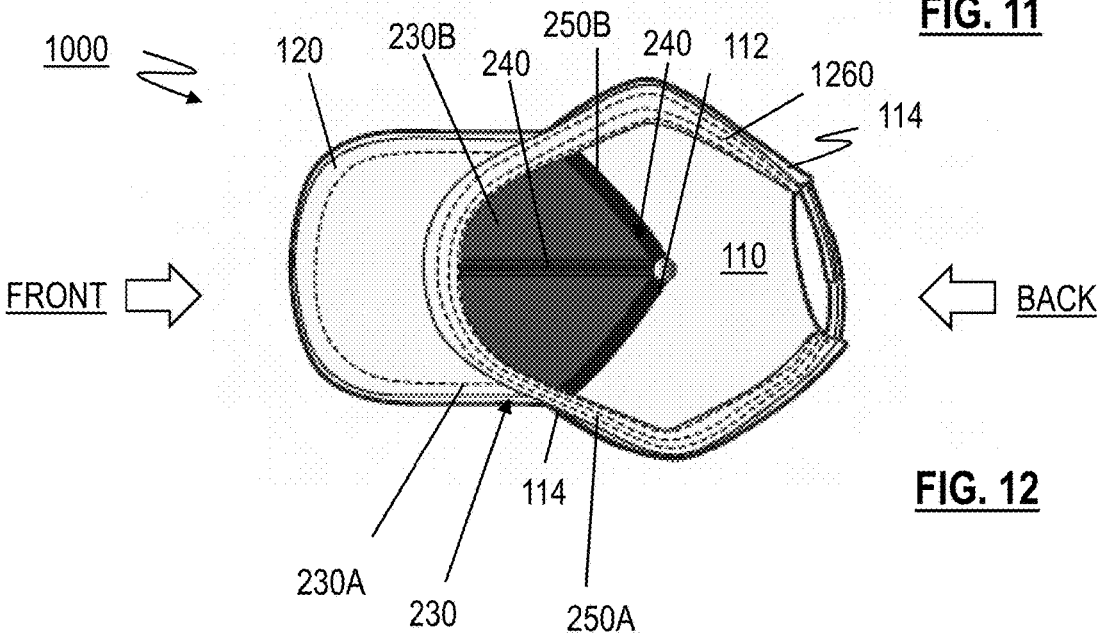

FIGS. 10, 11 and 12 are a top perspective view, a back view and a bottom view, respectively, of an example headwear such as a cap 1000 in accordance with a further embodiment. As shown in the example of FIG. 10, the cap 1000 includes a single-panel crown 110. A top button 112 and a visor 120 are attached (or connected) to the crown 110. The single-panel crown 110 has a hemispherical shape (e.g., a dome shape), and is formed of a stretchable fabric, preferably a light or lighter stretchable fabric. The fabric can be a woven or non-woven material, and can be an elastic fabric that is formed, such as for example with spandex (e.g., between 2% and 5% spandex, preferably around 3% spandex). Similar to the embodiment described with reference to FIG. 1, the single-panel crown 110 can be initially formed by heating and stretching a single sheet or single piece of a stretchable fabric into a hemispherical shape using a heat pressing system or heat press transfer machine with a suitable fabric-shaping mold or fabric mold (e.g., a hemispherical-shaped fabric mold).

As shown in FIG. 11, the single-panel crown 110 has a portion, such as a back portion, which is removed (e.g., cut out) to provide an open area 1160 in a back of the crown 110 of the cap 1000. In this example, the open area 1160 has an arcuate shape (e.g., semi-circular or dome shape). A strip(s) 1170 is attached along a running edge of the crown 110 around the open area 1160 to reinforce and finish the edge, and can be made of a material with an adhesive backing to connect the strip 1170 to the crown 110.

As further shown in FIG. 11, an adjuster 1180 is also connected to the crown 110 across the open area 1160 along a bottom edge 114 of the crown 110 of the cap 1000. The adjuster 1180 is configured to allow a size of the cap 1000 to be adjusted. In this example, the adjuster 1180 is a snap adjuster, which is a fastener with snap-on or snap-in components e.g., a first plastic member with a row of female parts (e.g., holes or opening) which are configured to receive male parts (e.g., protrusions) arranged along row on a second plastic member. The adjuster 1180, however, may take the form of other size adjustment mechanisms, such as a buckle adjuster (e.g., such as used in buckle adjustable hats), an elastic band(s), straps with fabric hooks, or so forth. The adjuster 1180 or components thereof can be connected to the crown 110 by stitching such as stitches 1182 (as in this example), by an adhesive, and/or by other attachment methods/mediums or a combination thereof.

As shown in FIG. 12, the cap 1000 also includes a support layer 230 as well as a band 1260. The support layer 230 is attached to an interior or inside of the single-panel crown 110 to provide structural support for a desired portion(s) of the single-panel crown 110 of the cap 100. In this example, the support layer 230 is attached to an interior, front portion of the single-panel crown 110.

The support layer 230 can be formed as a single panel or by connecting multiple support panels, and can be attached to the interior or inside of the single-panel crown 110 through heat transfer techniques using an adhesive (e.g., a fabric adhesive), as well as using bonding tape. For example, as with the example in FIG. 2, two support panels 230 together with a strip 240 of bonding tape or fabric are stitched, and a strip 240 covers the seam between the support panels 230 of FIG. 12. The support layer 230 can be formed of a rigid material, such as buckram. Two strips 250A and 250B of bonding tape are applied along respective seams between an outer edge or periphery of the support layer 230 and the interior of the single-panel crown 110. The strips 250A and 250B of bonding tape further attach the support layer 230 to the single-panel crown 110, and cover respective seams therebetween that extend radially from a central or center portion to a bottom edge (or rim) 114 of the single-panel crown 110. The bonding tape, as used herein, can be a single-sided or double-sided heat bonding tape or adhesive tape (e.g., a pressure sensitive adhesive tape). An adhesive, as used herein, can be a fabric adhesive that is applied with or without heat to bond two or more components together.

The band 1260 is attached around or along an interior of the bottom edge 114 of the crown 110 with the attached support layer 230. The band 1260 can be a sweat band, which is an elastic or inelastic band. The visor 120 and the band 1260 can be attached to the crown 110 by sewing or stitching them to the crown 110 (see, e.g., stitches or stitching 116 in FIGS. 1 and 10).

Figure 13:
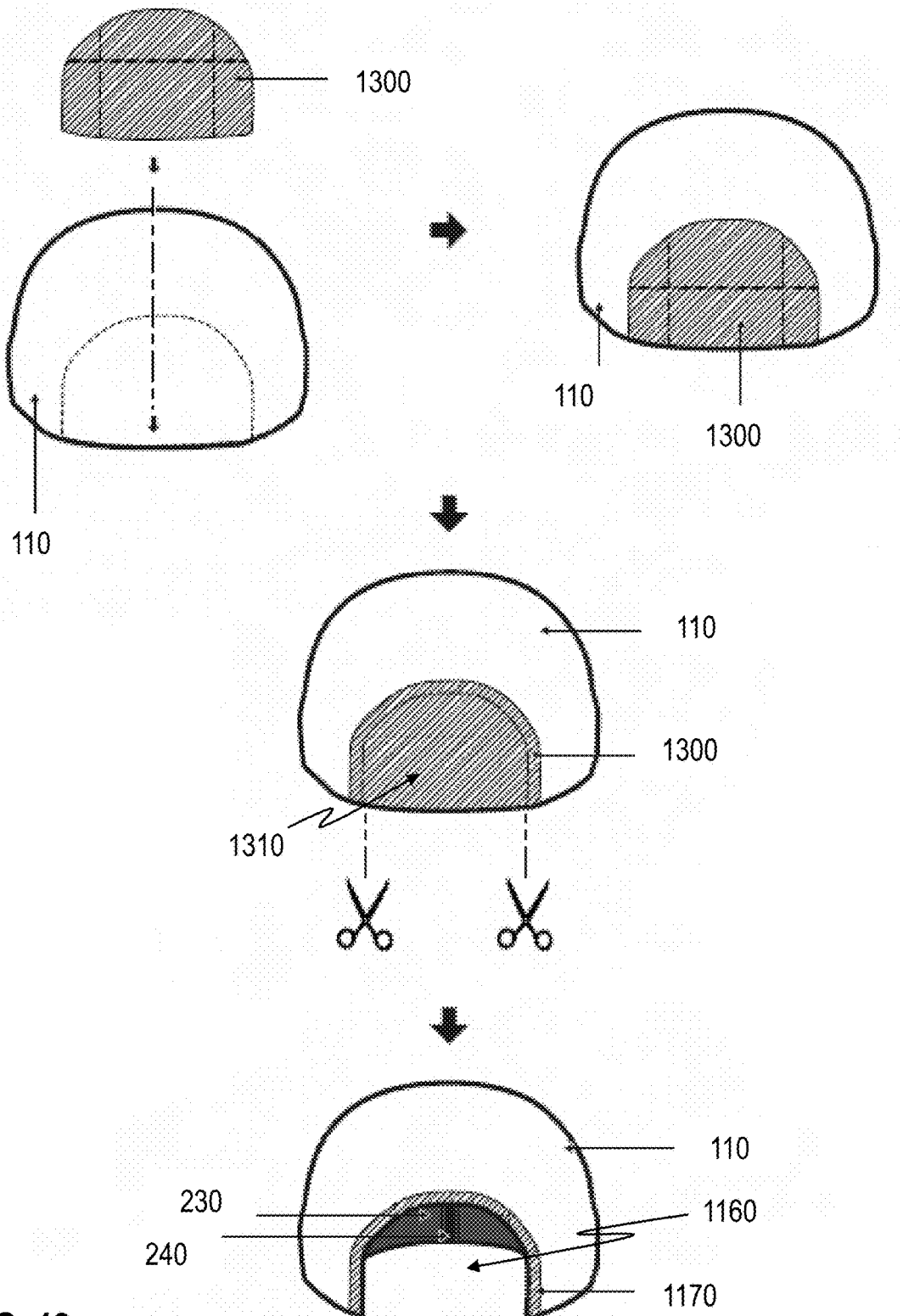
FIGS. 13 through 15 illustrate various operations involved in an exemplary process of assembling or manufacturing the cap of FIGS. 10 through 12.
Figure 14:
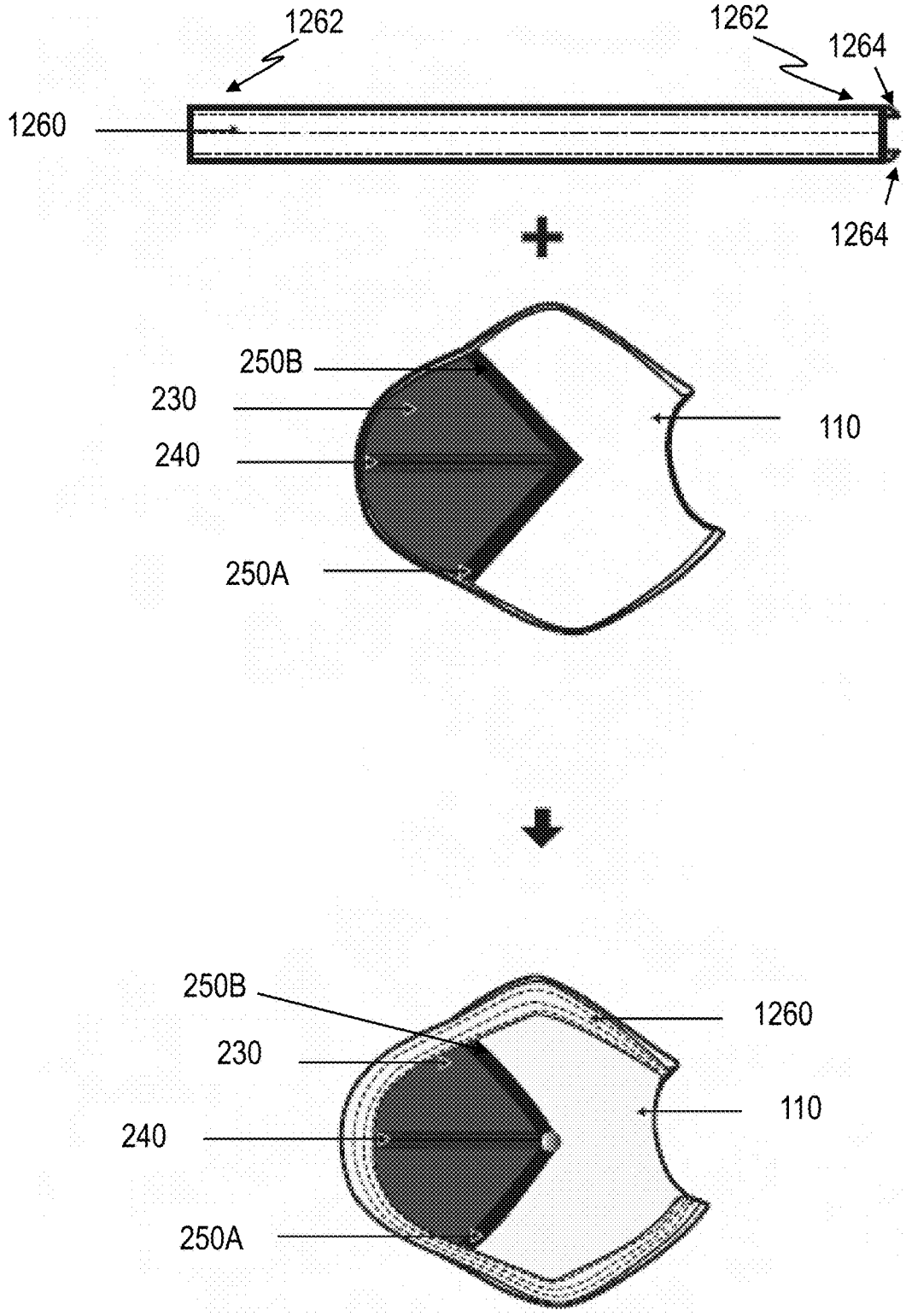
Figure 15:
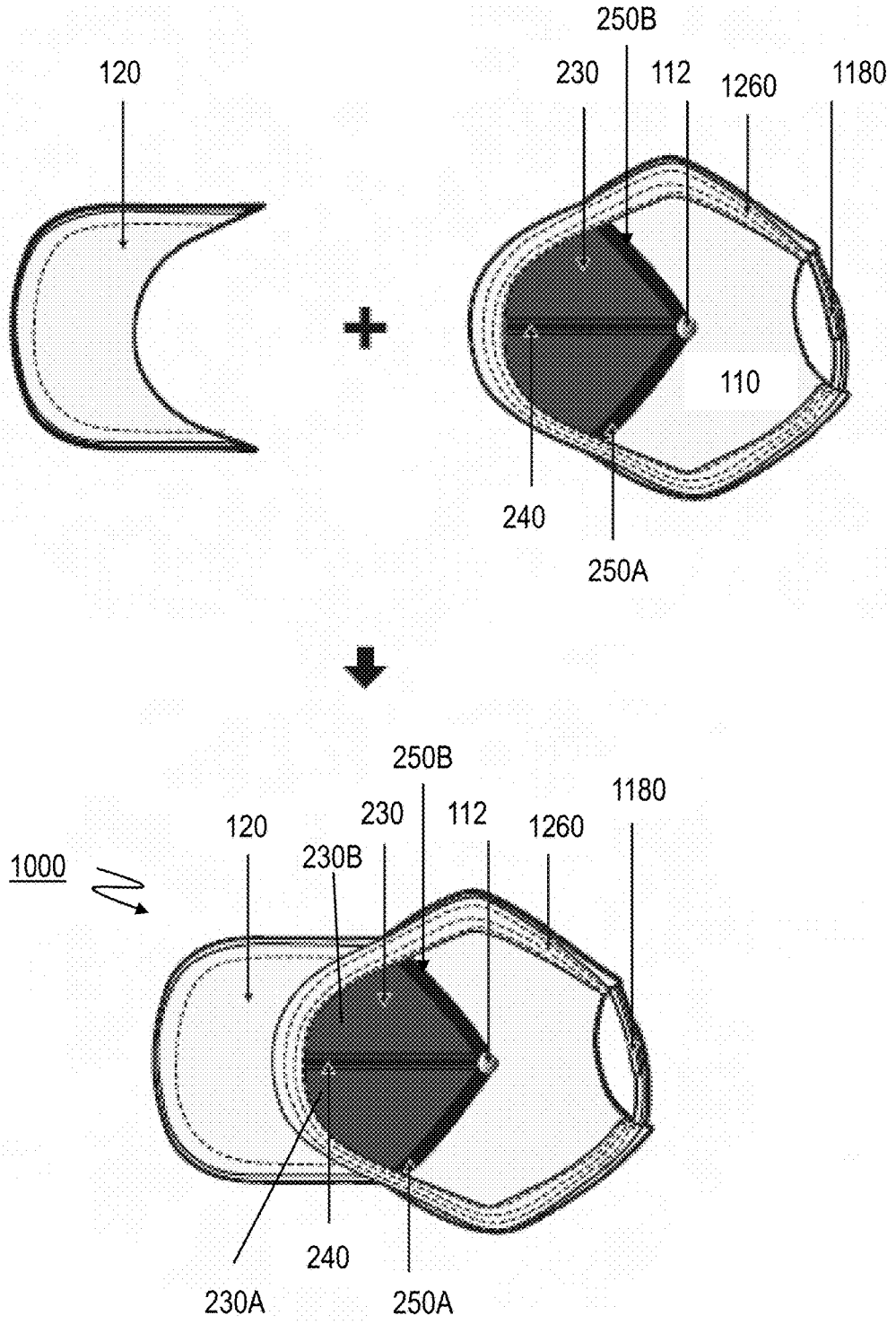

FIGS. 13 through 15 illustrate an exemplary step-by-step process of assembling or manufacturing the cap 1000 of FIGS. 10 through 12. As shown in FIG. 13, a crown 110 with a support layer 230 is provided. The crown 110 can be formed using the same or similar process discussed above with reference to FIGS. 3 through 5. A layer(s) 1300 of a material(s) is attached to an outer, back portion of the crown 110. The material can be a woven or non-woven fabric, or other substrate. The layer 1300 can have an adhesive on its backing (e.g., a material with an adhesive backing), or adhesive can be applied to the backing or the back portion of the crown 110 before connecting the layer 1300 to the crown 110. The layer 1300 can be formed of a material, which is more rigid (e.g., greater rigidity) than the material for the crown 110.

In this example, the layer 1300 has a predefined shape such as, for example, an arcuate shape (e.g., semi-spherical shape, dome shape, or the like), which corresponds to a desired shape of an open area to be provided on the crown 110. After the layer 1300 is aligned and then attached to a back portion of the crown 110 (see, e.g., dotted outline of the crown 110), a portion 1310 of the layer 1300 along with a corresponding portion of the crown 110 are removed (e.g., cut out). As shown in FIG. 13, the portion 1310 has a smaller arcuate shape, which when removed, leaves an open area 1160 at the back portion of the crown 110 and a strip 1170 of the layer 1300 running along the edge(s) of the crown 110 around the open area 1160.

As shown in FIGS. 14 and 15, the visor 120, the adjuster 1180 and the band 1260 are attached to the crown 110 (with the attached support layer 230). In this example, the band 1260 can be an elastic or inelastic band, such as a sweatband. The band 1260 includes two opposing end portions 1262, with each end portion 1262 having flaps 1264 which may be folded inward to form a pocket to receive an end of the adjuster 1180. The band 1260 is attached around an interior of the bottom edge 114 of the crown 110 (with the attached support layer 230). In this example, the adjuster 1180 has opposing ends attached to the crown 110 on respective opposing sides of the open area 1160. For example, each opposing end of the adjuster 1180 is arranged beneath, within or around a corresponding end portion 1262 of the band 1260, and is attached to both the crown 110 and the band 1260. The visor 120, the adjuster 1180 and the band 1260 can be attached to the crown 110 by sewing or stitching them to the single-panel crown 110 (see e.g., stitches or stitching 116, 1182 and other stitches in FIGS. 10-12 and other Figures), and/or with other attachment methods/mediums. The top button 112 is also attached to a central portion or center of the single-panel crown 110 with a metal snap or the like.

Figure 16:
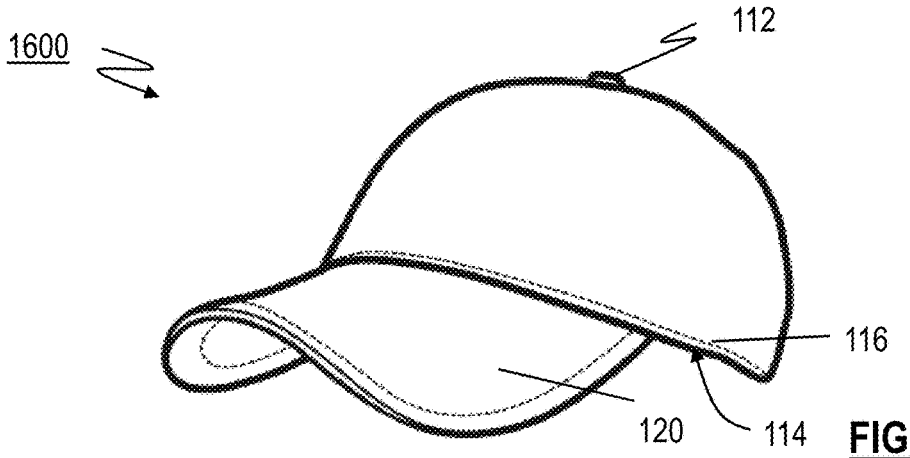
FIGS. 16, 17 and 18 are a top perspective view, a back view and a bottom view, respectively, of an example headwear such as a cap in accordance with another embodiment of the present disclosure.
Figure 17:
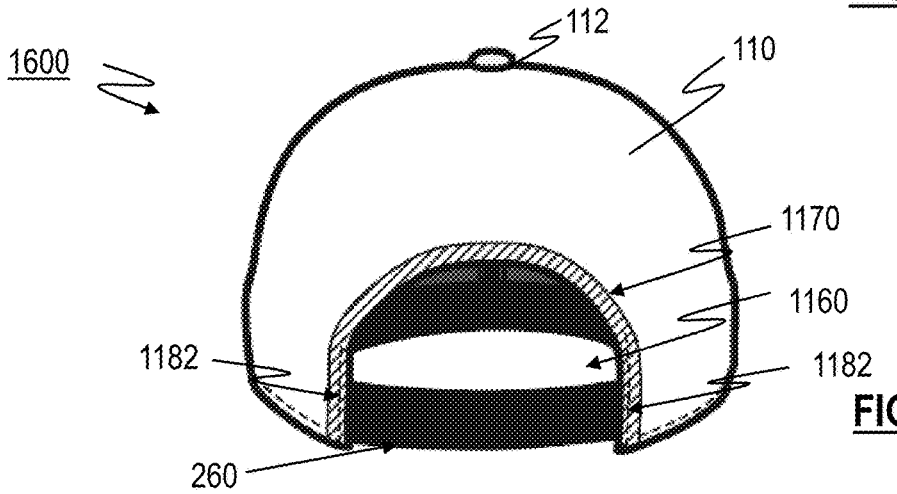
Figure 18:
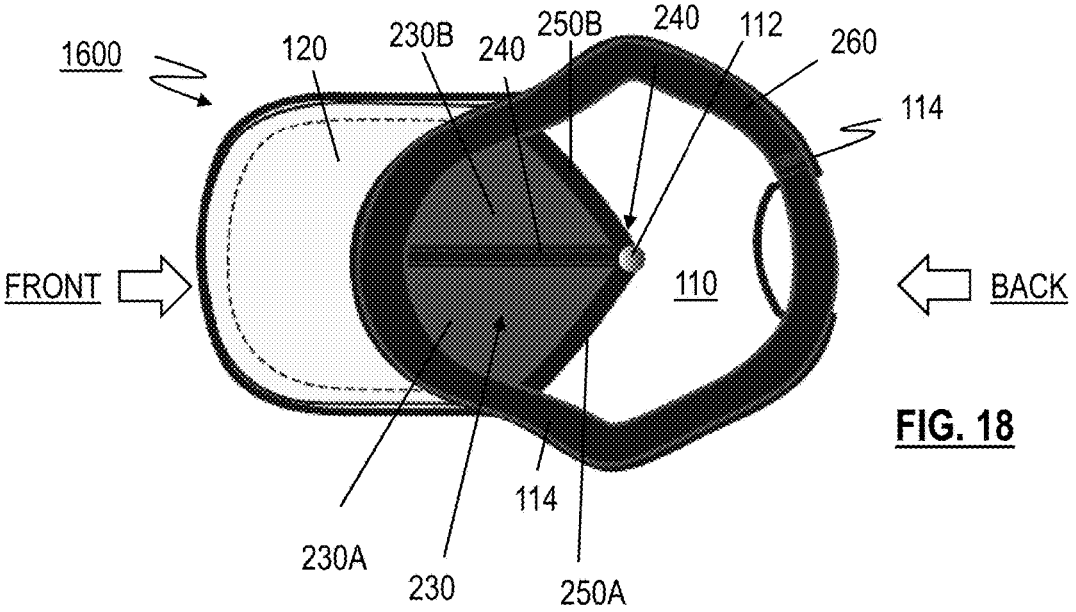

FIGS. 16, 17 and 18 are a top perspective view, a back view and a bottom view, respectively, of an example headwear such as a cap 1600 in accordance with another embodiment. The cap 1600 can include a number of the same or similar components and features as the cap 1000 (see, e.g., FIGS. 10-18) described above, except that the cap 1600 incorporates a band such as an elastic band 260, instead of the combination of the adjuster 1180 and the band 1260. In this example, the band 260 extends across the open area 1160 at the back portion of the crown 110.

Figure 19:
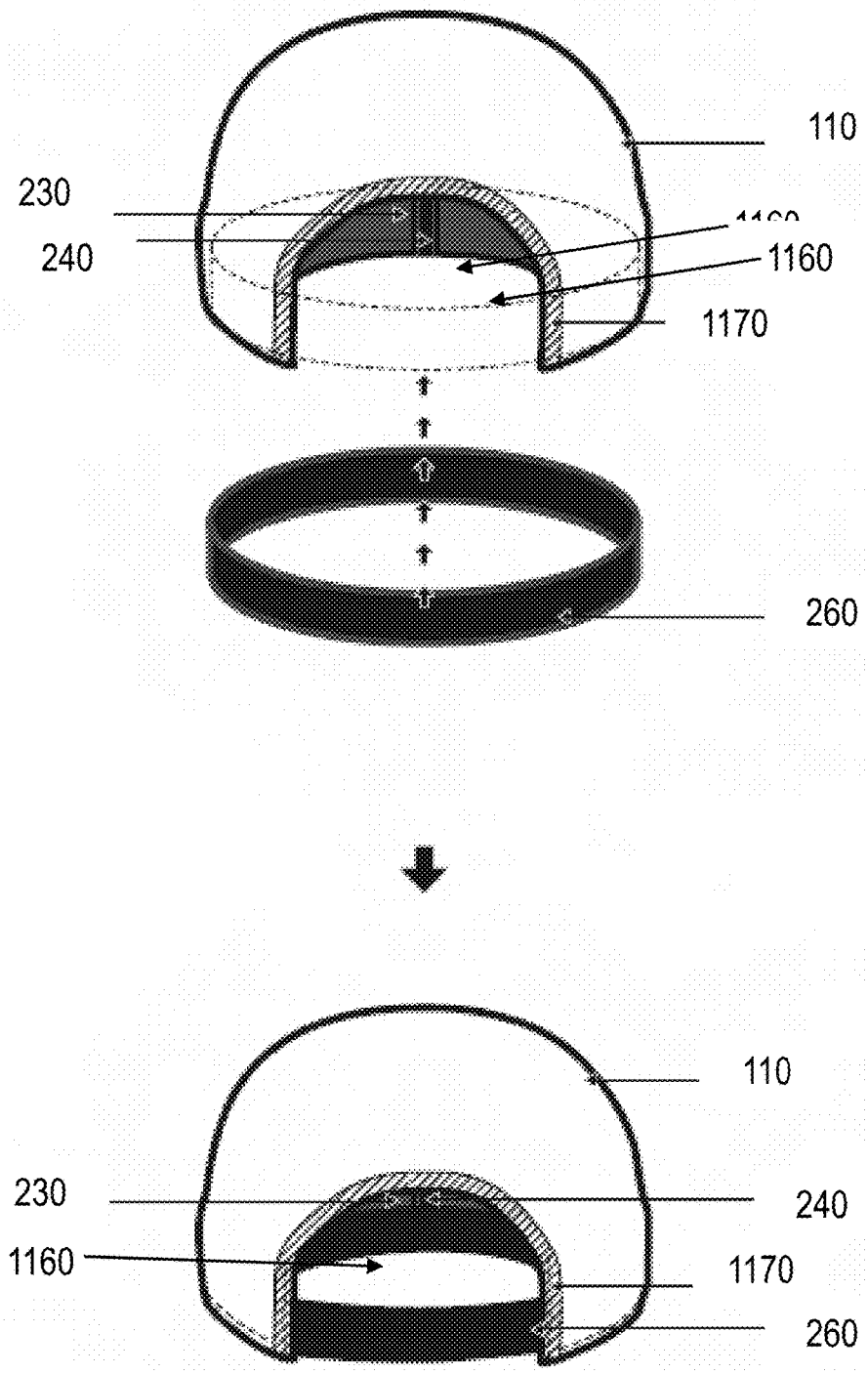
FIGS. 19 and 20 illustrate various operations involved in an exemplary process of assembling or manufacturing the cap of FIGS. 16 through 18.
Figure 20:
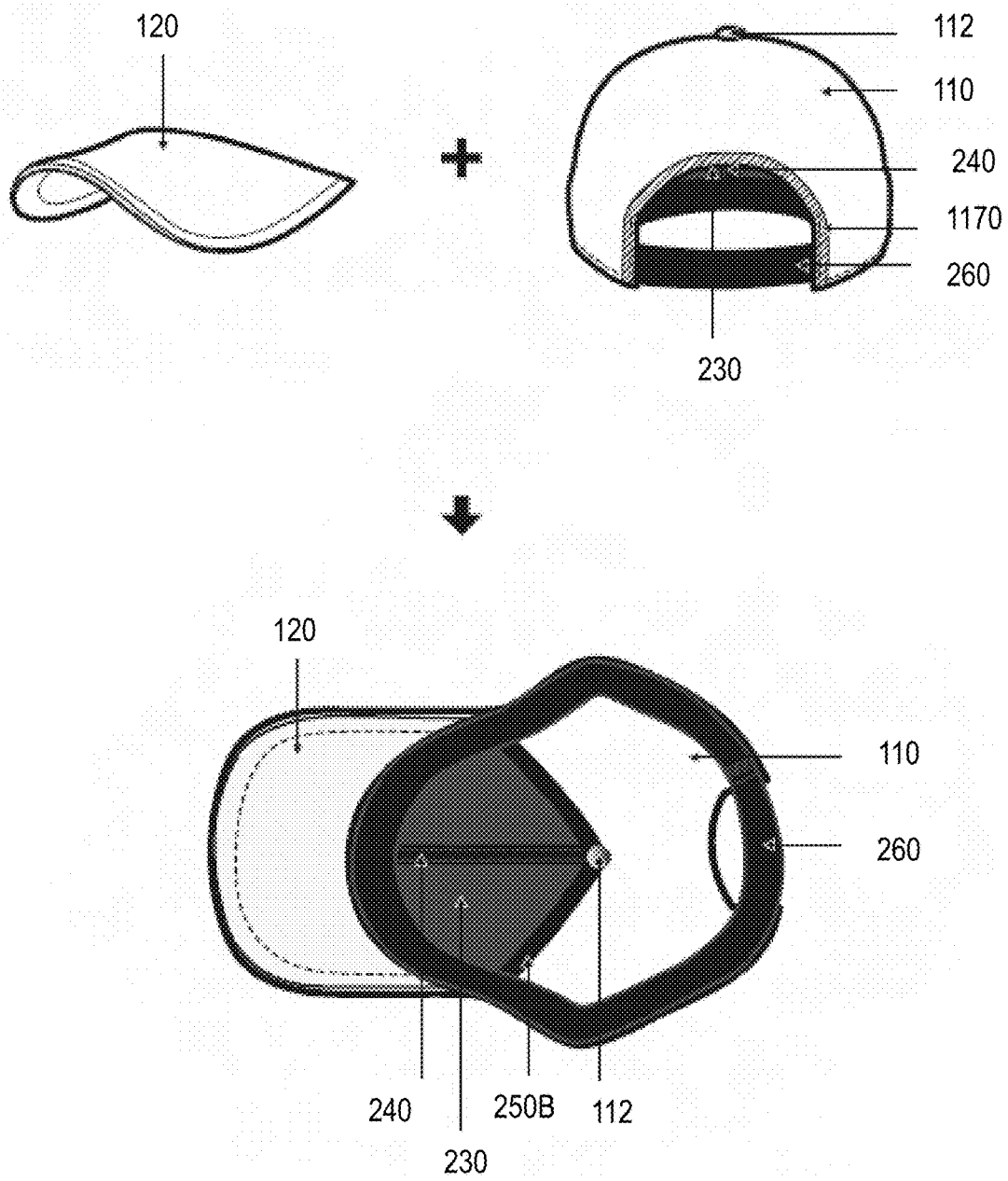

FIGS. 19 and 20 illustrate various operations involved in an exemplary process of assembling or manufacturing the cap 1600 of FIGS. 16 through 18. As shown in FIG. 19, a crown 110 is provided which includes a support layer 230 and an open area 1160 having an arcuate shape at a back portion of the crown 110. This configuration for the crown 110 can be assembled or manufactured, for example, using the process previously described above for the cap 1000 with reference to FIG. 13. Thereafter, a band such as, for example, the elastic band 260 is attached to the crown 110 around an interior of the bottom edge 114 of the crown 110. In this example, the band 260 is attached to the crown by sewing or stitching. As further shown in FIG. 20, a visor 120 is then attached to the crown 110 (with the support layer 230). In this example, the visor 120 is attached to the crown by sewing or stitching.

The above describes one example process of assembling or manufacturing the cap 1600. The various components of the cap 1600, however, can be assembled in a different order and/or different operations can be combined in the process. For example, the visor 120 and the elastic band 260 can be attached to the crown 110 by sewing or stitching them together to the single-panel crown 110 (see e.g., stitches or stitching 116 in FIG. 1) or separately to the single-panel crown 110.

Figure 21:
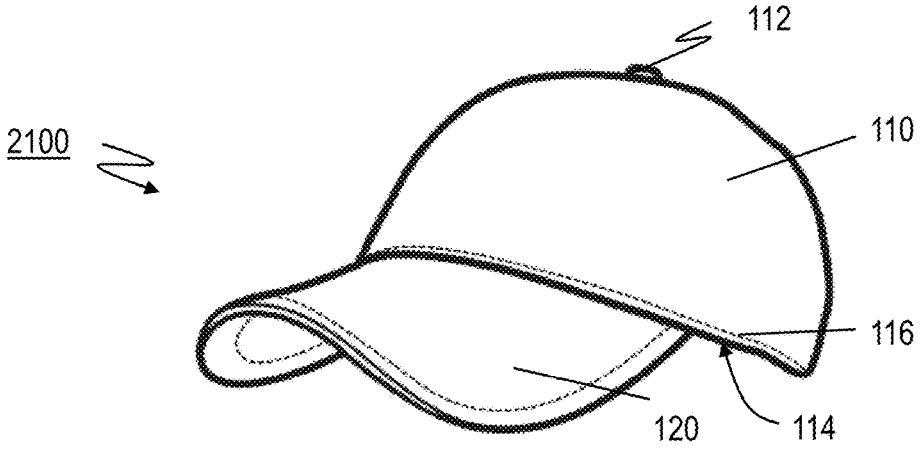
FIGS. 21, 22 and 23 are a top perspective view, a back view and a bottom view, respectively, of an example headwear such as a cap in accordance with yet a further embodiment of the present disclosure.
Figure 22:
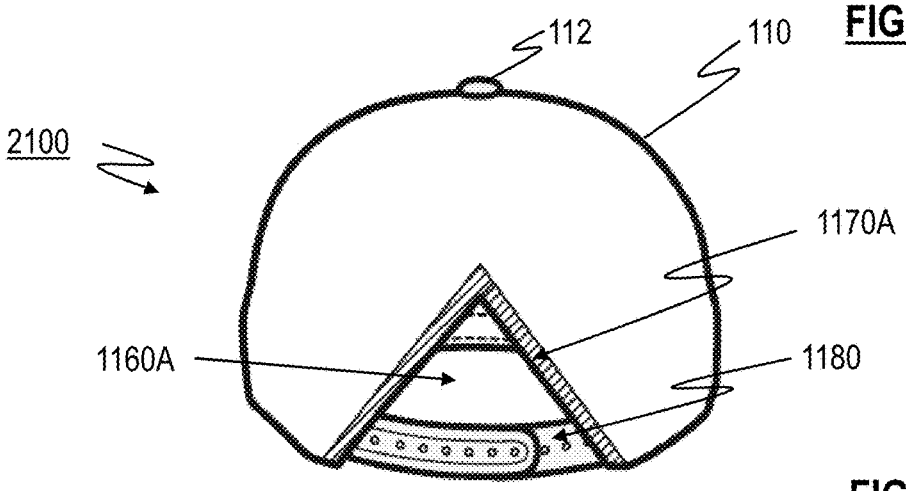
Figure 23:
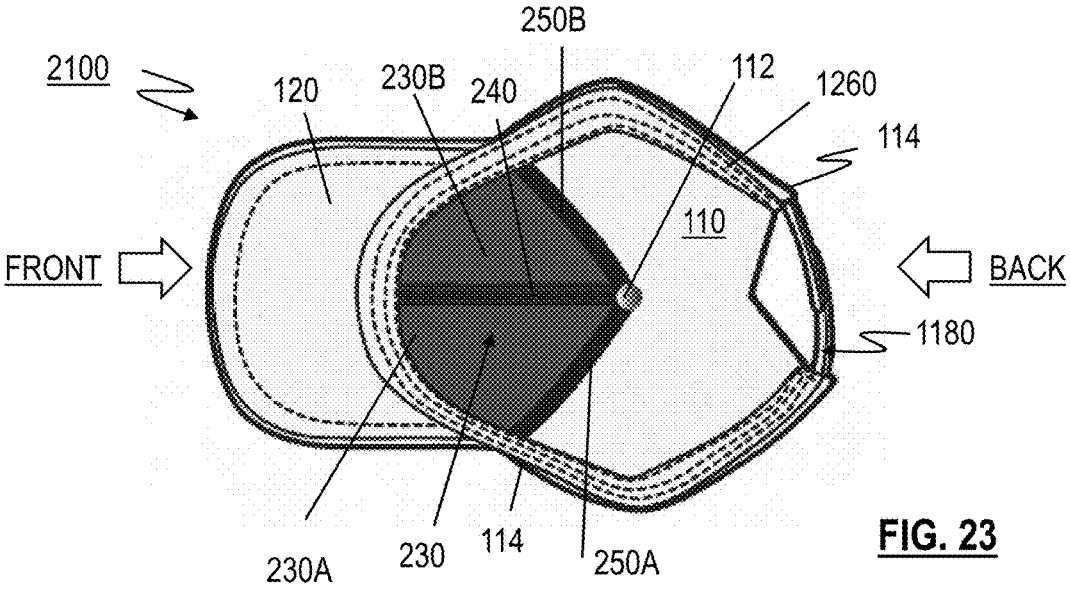

'FIGS. 21, 22 and 23 are a top perspective view, a back view and a bottom view, respectively, of an example headwear such as a cap 2100 in accordance with yet a further embodiment. The cap 2100 can include a number of the same or similar components and features as the cap 1000 (see, e.g., FIGS. 10-18) described above, except that the cap 2100 has an open area 1160A at the back portion of the crown 110 with a triangular shape, rather than an arcuate shape (see, e.g., the open area 1160 in FIG. 13). Accordingly, the cap 2100 can be assembled or manufactured in general using the same or similar processes that are used for the cap 1000 described above. In this example, a layer(s) of material, which is attached to the back of the crown 110, would have a triangular shape instead of an arcuate shape (see, e.g., the layer 1300 in FIG. 13). A smaller portion of the attached layer(s) and the crown 110, with a triangular shape, is removed to provide a strip 1170A of the material, which runs along an edge of the crown 110 around the open area 1160A.

Figure 24:
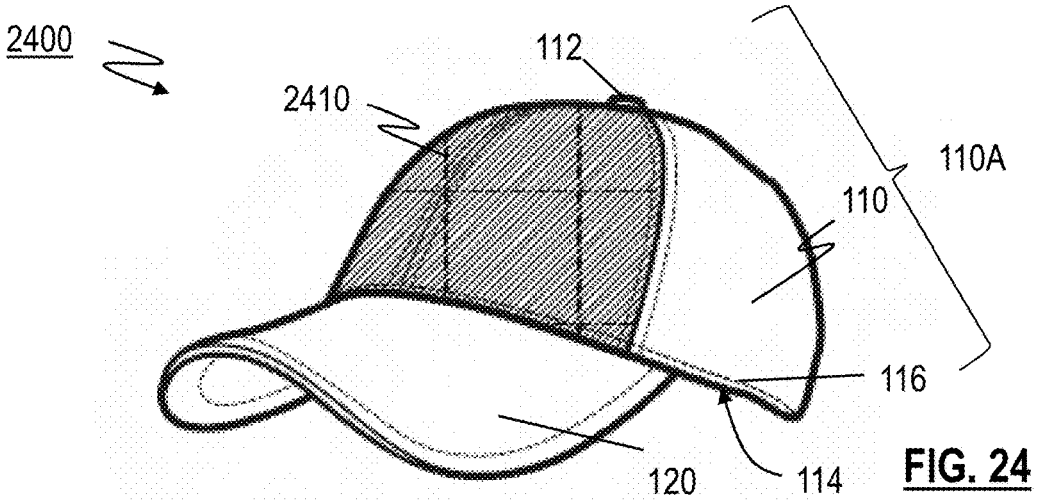
FIGS. 24, 25 and 26 are a top perspective view, a back view and a bottom view, respectively, of an example headwear such as a cap in accordance with yet another embodiment of the present disclosure.
Figure 25:
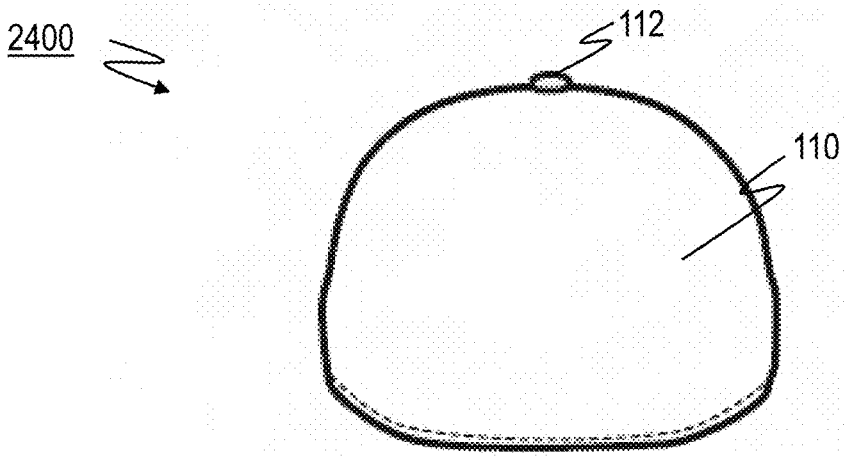
Figure 26:
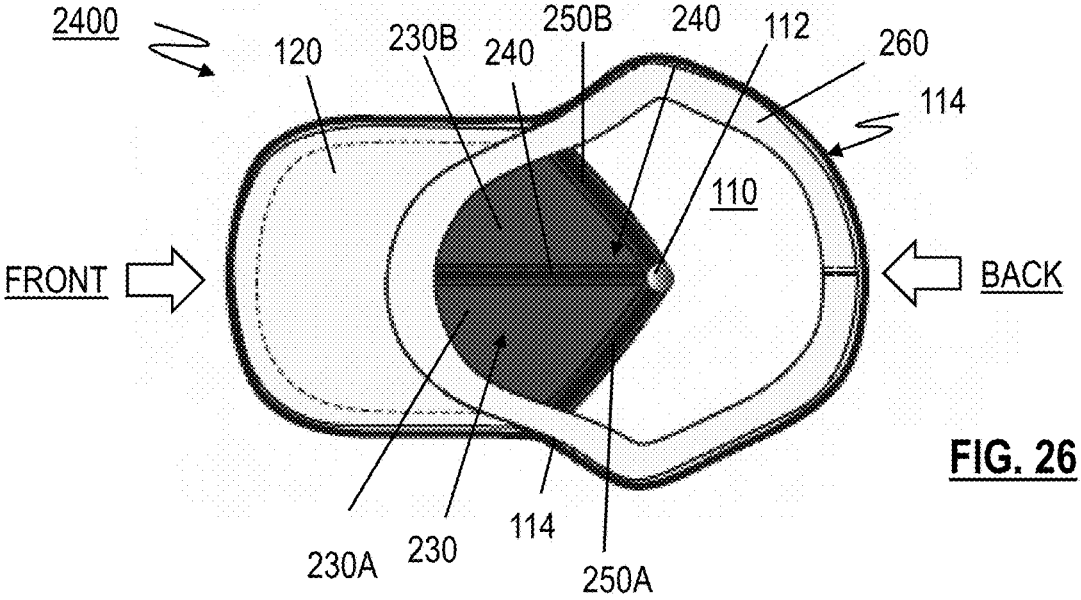

FIGS. 24, 25 and 26 are a top perspective view, a back view and a bottom view, respectively, of an example headwear such as a cap 2400 in accordance with yet another embodiment. In this example, the cap 2400 includes a number of the same or similar components as the cap 100 of FIGS. 1-8, except that the initial crown 110 is subsequently modified to incorporate a front panel 2410 (e.g., an outer front panel) in order to form a modified crown 110A for the cap 2400. The initial crown 110 has different properties than that of the front panel 2410, including, for example, physical and/or visual features. For example, the initial crown 110 can be made of a different material (e.g., different fabrics, different mediums, etc.) than the front panel 2410. The front panel 2410 can be formed as a single-panel, or from two or more panels connected together using tape, stitches and/or other attachment methods/mediums.

Figure 27:
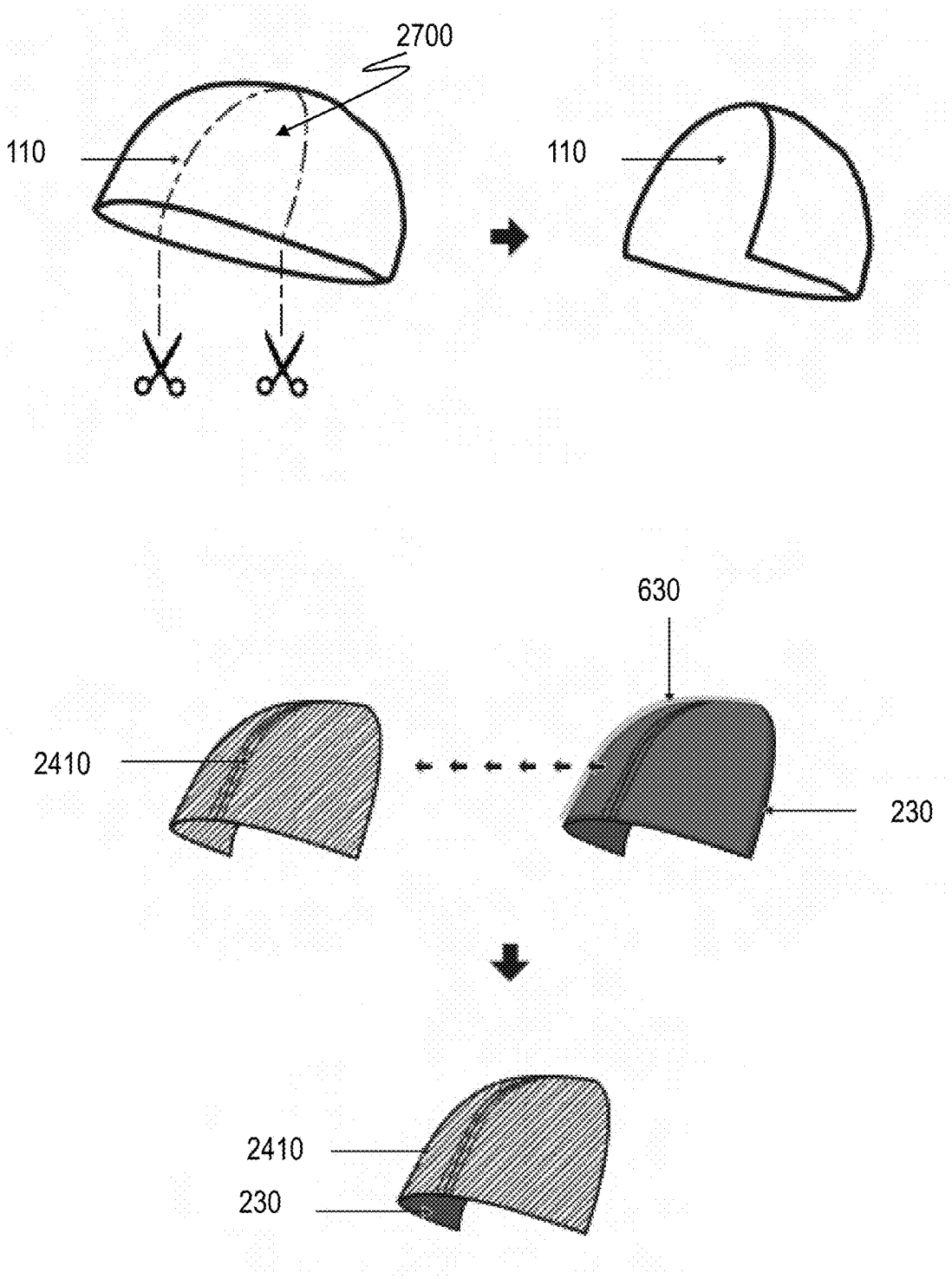
FIGS. 27 through 30 illustrate various operations involved in an exemplary process of assembling or manufacturing the cap of FIGS. 24 through 26.

FIGS. 27 through 30 illustrate various operations involved in an exemplary process of assembling or manufacturing the cap 2400 of FIGS. 24 through 26. As shown in FIG. 27, an initial crown, e.g., a single-panel crown 110, is provided which can be formed using the example assembling or manufacturing process described above for the cap 100 with reference to FIGS. 3-5. In FIG. 27, a front portion 2700 of the initial crown 110 is removed, e.g., cut-out. The front panel 2410 is provided, and a support layer 230 is attached to a back or inner-side of the front panel, such as using an adhesive (e.g., a coating of adhesive 630), or other attachment methods/mediums.

Figure 28:
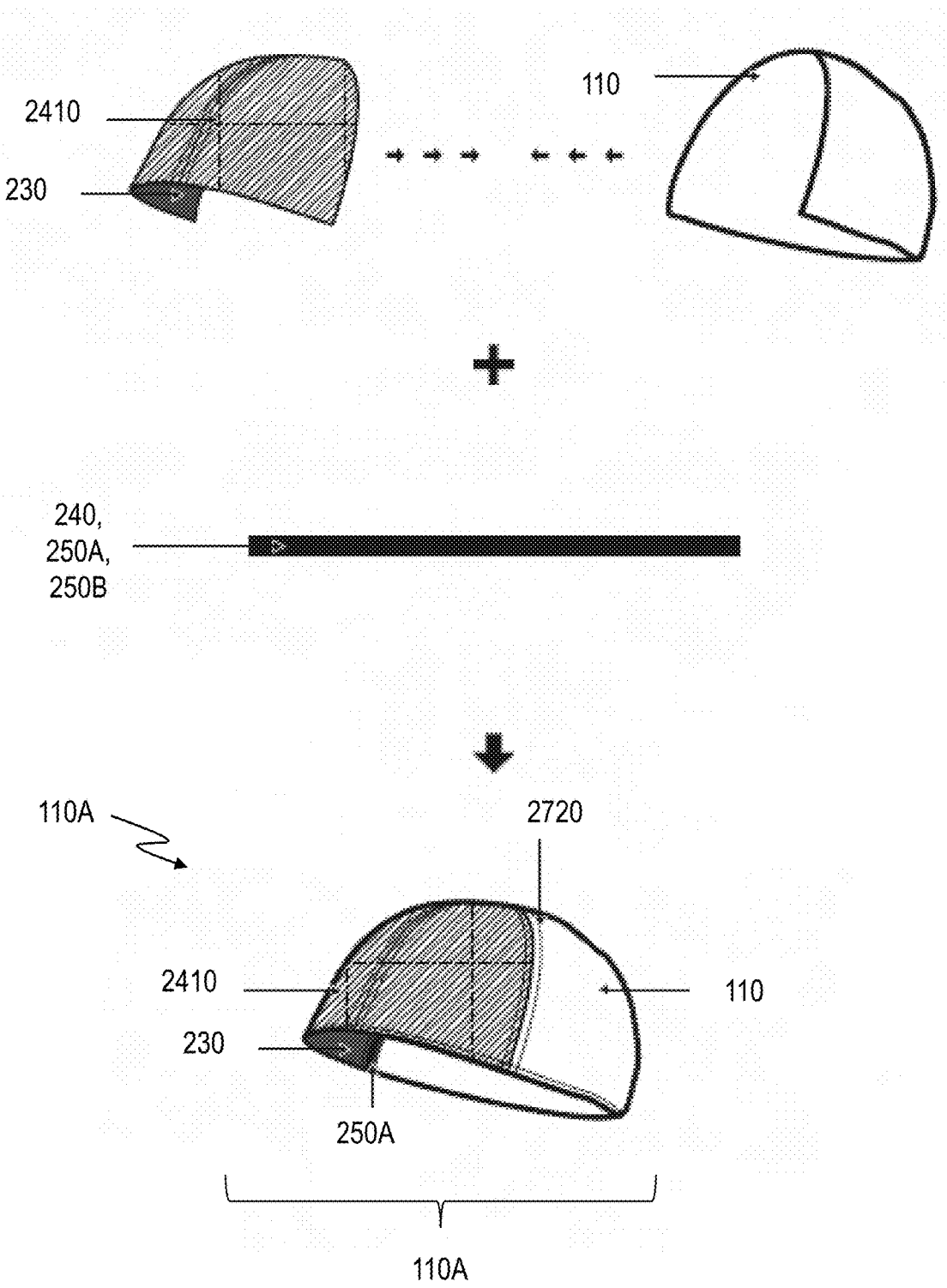

As shown in FIG. 28, the front panel 2410 is attached to the crown 110 to replace the removed front portion 2700 of the initial crown 110 and to form the modified crown 110A. The front panel 2410 with the support layer 230 can be attached to the initial crown 110 by sewing or stitching the components together as shown by stitches 2720. Furthermore, two strips of bonding tape 250A and 250B, which are applied over interior seams between the front panel 2410 and the initial crown 110. An edge of the initial crown 110 (around the removed front portion 2700) is positioned over (or overlaps) an edge of the front panel 2410, or vice-a-versa.

Figure 29:
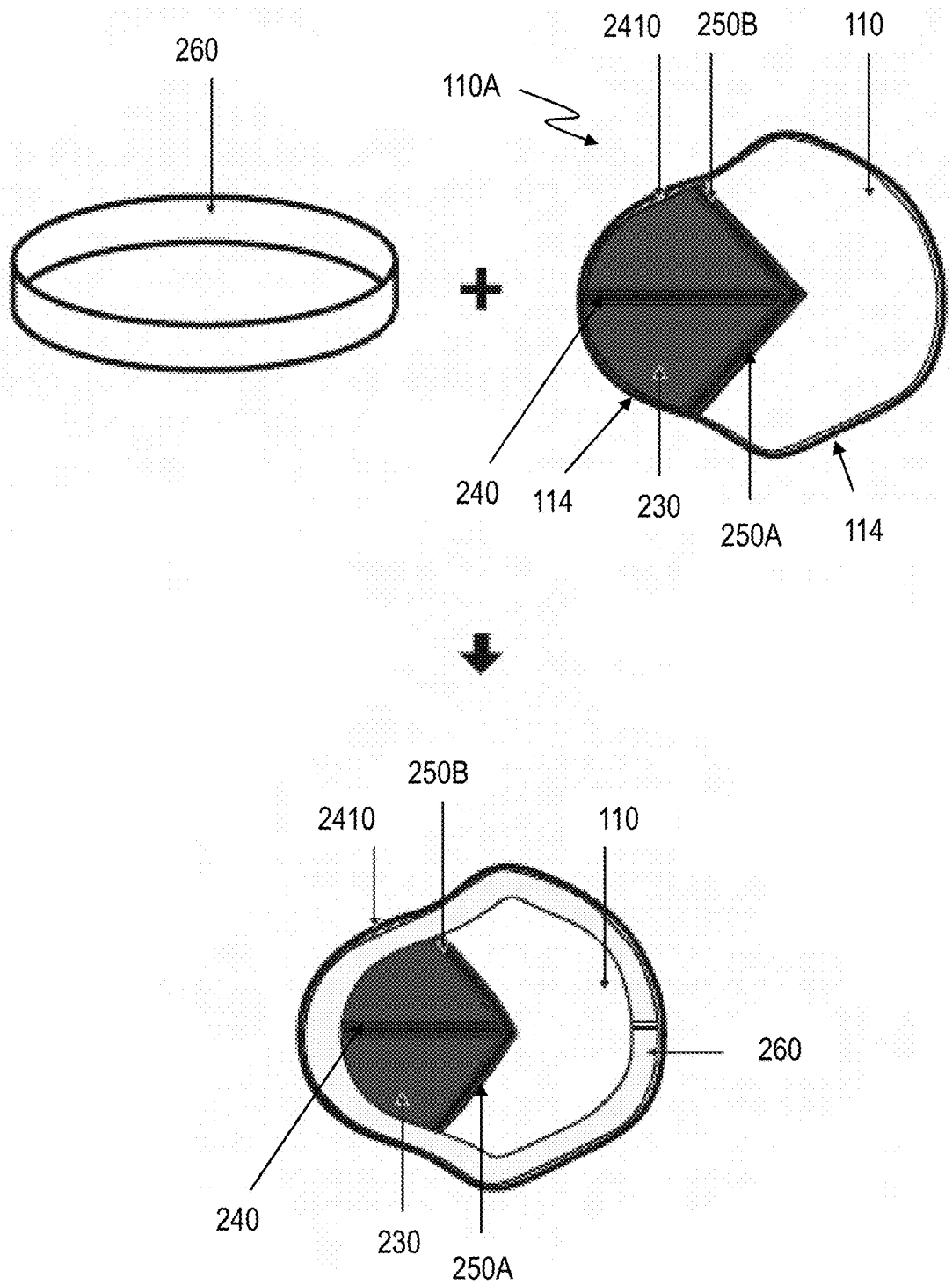
Figure 30:
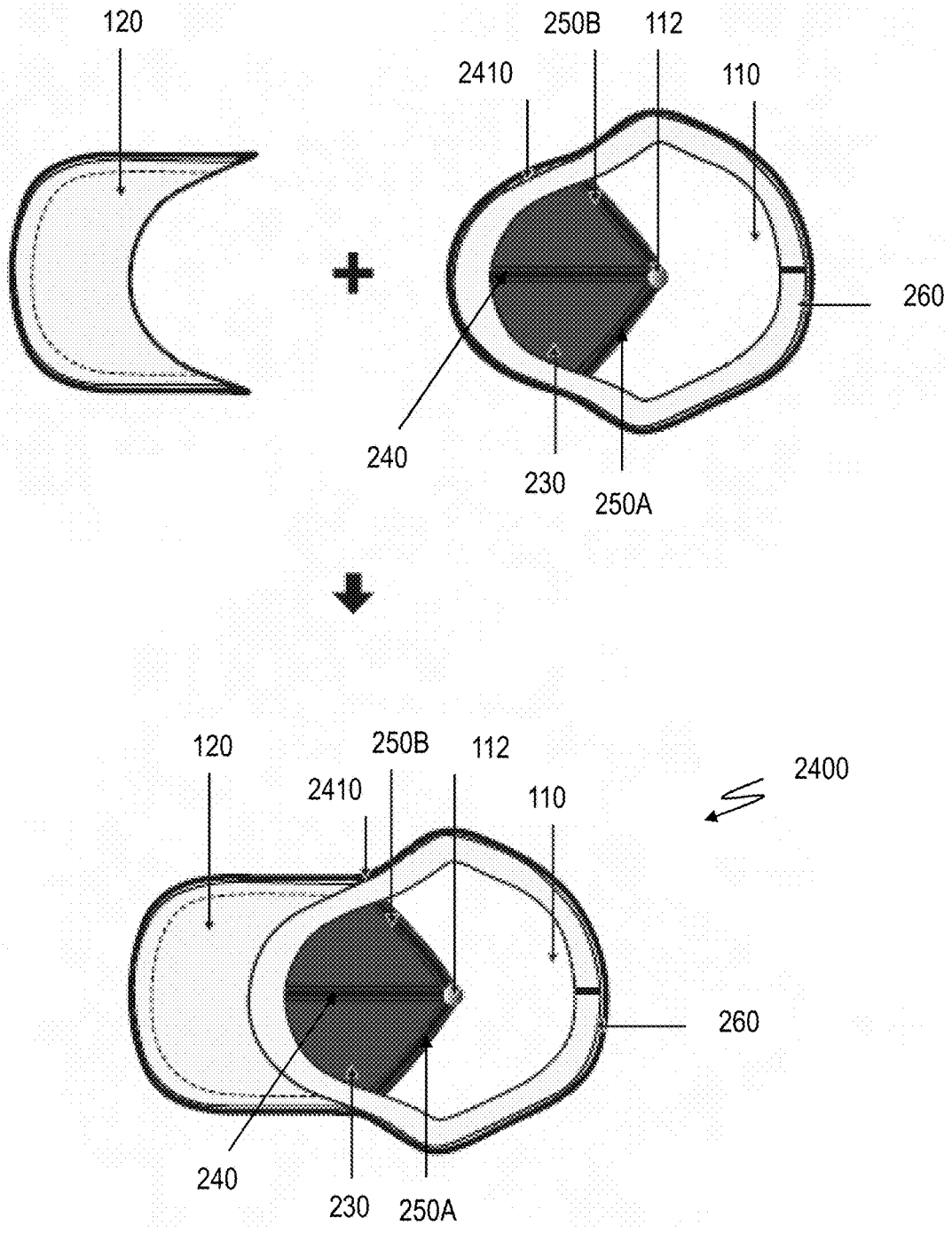

Thereafter, as shown in FIG. 29, a band such as, for example, an elastic band 260 is attached to the modified crown 110A around an interior of the bottom edge 114 of the crown 110A. In this example, the band 260 is attached to the crown by sewing or stitching. As further shown in FIG. 29, a visor 120 is then attached to the modified crown 110A. In this example, the visor 120 is attached to the crown by sewing or stitching.

The above describes one example process of assembling or manufacturing the cap 2400. The various components of the cap 2400, however, can be assembled in a different order and/or different operations can be combined. For example, the visor 120 and the elastic band 260 can be attached to the crown 110 by sewing or stitching them together to the single-panel crown 110 (see e.g., stitches or stitching 116 in FIG. 1) or separately to the single-panel crown 110. The support layer 230 may also be attached after the front panel 2410 is attached to the crown 110. Furthermore, the cap 2400 can be modified to incorporate an open area at the back portion of the crown 110A. The cap 240 can also be modified to incorporate a combination of a band and adjuster, such as those described herein for the various cap examples, instead of a continuous band.

The headwear and method of assembling thereof, which are shown and described above with reference to the figures, are simply provided as examples. It should be understood that the headwear can include a crown having a different or varying size, shape and configuration. Although the headwear in FIGS. 1 and 2, as well as FIGS. 10-12, 16-18, 21-23 and 24-26, are shown as a particular type of a cap, such as a baseball cap, the crown manufacturing technique described herein can be used to assemble or manufacture other types of caps with a visor (e.g., a bill) and having a different or varying dimensions (e.g., size and shape). In general, headwear components (including those described herein), layers of materials or accessories (e.g., lining, liners or backing for the single-panel crown, etc.) can also be attached or connected using various attachment methods/mediums, such as sewing or stitching, adhesive (e.g., fabric adhesive), bonding tape, or a combination thereof and/or other conventional techniques for attaching components of a headwear together. Furthermore, the assembling operations can be performed in a different order, and may omit some operations or add other operations to assemble a cap with a single-panel crown. Furthermore, the open area (or removed back portion) of the crown can take other shapes and forms other than arcuate or triangular shape, and the example caps described herein can incorporate different types of adjusters or adjustment configurations.

As discussed herein, a stretchable fabric can be heated and stretched into a desired shape with a heat press transfer machine or heat pressing system that employs fabric mold. The fabric mold can include a male mold part (e.g., mold 10 in FIGS. 3 and 4) and a counterpart-female mold part, which when engaged stretches the stretchable fabric arranged therebetween into a desired shape according to the shape of the mold parts (e.g., hemispherical shape). Alternatively, the fabric mold may include only a male mold part, upon which the stretchable fabric is pressed against and stretched.

Words of degree, such as "about", "substantially", and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the invention.

The invention claimed is:

1. A method of assembling a cap comprising:

forming a single-panel crown for a cap from a single sheet or single piece of stretchable fabric;

removing a back portion of the crown to form an open area;

attaching a support layer to an interior portion of the single-panel crown; and attaching a visor and a band to the crown with the attached support layer.

2. The method according to claim 1, further comprising:

attaching a layer of material along an edge of a back of the crown which is formed by the removal of the back portion.

3. The method according to claim 1, wherein the band comprises an elastic band, the elastic band extending along an interior rim of the crown across the open area of the crown.

4. The method according to claim 1, wherein the band comprises a sweatband, the method further comprising:

attaching an adjuster to a bottom of the crown across the open area, the adjuster being configured to adjust a size of the cap.

5. The method according to claim 1, wherein the back portion, which is removed, has an arcuate or triangular shape.

6. The method according to claim 1, wherein the removing comprises:

attaching a layer of material to a back of the crown, the layer of material having a predefined shape corresponding to a desired shape of the open area; and removing a portion of the layer of material along with the crown to form the open area with the desired shape so that a strip of the layer of material runs along an edge of a back of the crown around the open area.

7. The method according to claim 6, wherein the stretchable fabric comprises a woven or non-woven material, the stretchable fabric including 2% to 5% spandex.

8. The method according to claim 1, wherein the support layer comprises buckram, the attaching a support layer comprising:

applying an adhesive to a surface of the buckram or an interior, front portion of the single-panel crown;

pressing the buckram against the interior, front portion of the single-panel crown so that the adhesive bonds the buckram to the interior, front portion of the single-panel crown; and applying bonding tape over one or more seams that are formed between an edge of the buckram and an interior surface of the crown, each of the one or more seams extending radially from an interior, central portion to a bottom edge of the crown, the bonding tape covering the one or more seams and further connecting the buckram to the crown.

9. The method according to claim 1, wherein the attaching a visor comprises stitching the visor and the band to the crown, the band attached around an interior, bottom edge of the crown.

10. The method of claim 1, wherein the single sheet or single piece of stretchable fabric comprises a fabric blank of the stretchable fabric, wherein the forming a single-panel crown comprises:

heating and stretching the fabric blank of the stretchable fabric to form a single-panel crown having a hemispherical shape.

11. Headwear comprising a cap that includes:

a single-panel crown formed from a single sheet or single piece of stretchable fabric and having a hemispherical shape, the crown having a back portion which is cut out to form an open area;

a support layer attached to an interior portion of the single-panel crown; and a visor and a band that are attached to the single-panel crown.

12. The headwear according to claim 11, wherein a layer of material is attached to a back of the crown, and has a predefined shape corresponding to a desired shape of the open area, and wherein a portion of the layer of material is removed along with the crown to form the open area with the desired shape so that a strip of the layer of material runs along an edge of a back of the crown around the open area.

13. The headwear according to claim 12, wherein the stretchable fabric comprises a woven or non-woven material, the stretchable fabric including 2% to 5% spandex.

14. The headwear according to claim 11, wherein the support layer comprises buckram, which is heat bonded to an interior, front portion of the single-panel crown using an adhesive, the headwear further comprising:

bonding tape applied over one or more seams that are formed between an edge of the buckram and an interior surface of the crown, each of the one or more seams extending radially from an interior, central portion to a bottom edge of the crown, the bonding tape covering the one or more seams and further connecting the buckram to the single-panel crown, wherein the visor and the band are stitched to the single-panel crown, the elastic band being attached around an interior, bottom edge of the single-panel crown.

15. The headwear according to claim 11, further comprising:

a layer of material attached along an edge of a back of the crown which is formed by the removal of the back portion.

16. The headwear according to claim 11, wherein the band comprises an elastic band, the elastic band extending along an interior rim of the crown across the open area of the crown.

17. The headwear according to claim 11, wherein the band comprises a sweatband, the headwear further comprising:

an adjuster to adjust a size of the cap, the adjuster being attached to a bottom of the crown across the open area of the crown.

18. The headwear according to claim 11, wherein the back portion, which is cut out, has an arcuate or triangular shape.

19. A method of assembling a cap comprising:

forming an initial single-panel crown from a single sheet or single piece of stretchable fabric;

removing a front portion of the initial single-panel crown;

attaching a front panel to the crown to replace the removed front portion and to form a modified crown for a cap, the front panel being formed of a different material than the initial crown and having a support layer attached on an interior side of the front panel; and attaching a visor and a band to the modified crown.

20. The method according to claim 19, wherein the support layer is attached to the front panel prior to attaching the front panel to the initial single-panel crown with the removed front portion.

21. The method according to claim 19, wherein the stretchable fabric comprises a woven or non-woven material.

22. The method according to claim 21, wherein the stretchable fabric includes 2% to 5% spandex.

23. The method according to claim 19, wherein an edge of the initial single-panel crown with the removed front portion is attached over an edge of the front panel.

24. The method according to claim 19, wherein the front panel is smaller than the initial single-panel crown with the removed front portion.

25. Headwear comprising:

a crown having an initial single-panel crown formed from a single sheet or single piece of stretchable fabric with a front portion of the initial single-panel crown being removed, and a front panel attached to the initial single-panel crown to replace the removed front portion, the front panel being formed of a different material than the initial crown and having a support layer attached on an interior of the front panel; and a visor and a band attached to the modified crown.

26. The headwear according to claim 25, wherein the support layer is attached to the front panel prior to attaching the front panel to the initial crown.

27. The headwear according to claim 25, wherein the stretchable fabric comprises a woven or non-woven material.

28. The headwear according to claim 27, wherein the stretchable fabric includes 2% to 5% spandex.

29. The headwear according to claim 25, wherein an edge of the initial single-panel crown with the removed front portion is attached over an edge of the front panel.

30. The headwear according to claim 25, wherein the front panel is smaller than the initial single-panel crown with the removed front portion.

* * * * *